US010975798B2

(12) United States Patent
Engelmann

(10) Patent No.: US 10,975,798 B2
(45) Date of Patent: Apr. 13, 2021

(54) ENHANCED PISTON FOR IMPROVING THE EFFICIENCY OF AN INTERNAL COMBUSTION ENGINE

(71) Applicant: Mark Engelmann, Central City, IA (US)

(72) Inventor: Mark Engelmann, Central City, IA (US)

( * ) Notice: Subject to any disclaimer, the term of this patent is extended or adjusted under 35 U.S.C. 154(b) by 142 days.

(21) Appl. No.: 16/537,817

(22) Filed: Aug. 12, 2019

(65) Prior Publication Data

US 2021/0047982 A1 Feb. 18, 2021

(51) Int. Cl.

| | |
|---|---|
| ***F02B 23/06*** | (2006.01) |
| ***F02F 3/04*** | (2006.01) |
| ***F02F 11/00*** | (2006.01) |
| ***F02F 3/02*** | (2006.01) |

(52) U.S. Cl.

CPC ..... *F02F 3/042* (2013.01); *F02B 23/06* (2013.01); *F02F 3/027* (2013.01); *F02F 11/007* (2013.01)

(58) Field of Classification Search

CPC ..... F02B 23/06; F02B 23/0633; F02F 3/027
USPC ..... 123/73 AV, 193.6
See application file for complete search history.

(56) References Cited

U.S. PATENT DOCUMENTS

| | | | | | |
|---|---|---|---|---|---|
| 1,029,929 | A * | 6/1912 | Hellmann | F02B 41/04 | 123/47 AB |
| 1,082,402 | A * | 12/1913 | Campbell | F02B 75/22 | 123/152 |
| 2,431,859 | A * | 12/1947 | Fisher | F02B 25/00 | 123/47 A |
| 3,301,234 | A * | 1/1967 | Reilly | F02B 25/00 | 123/47 R |
| 6,145,488 | A * | 11/2000 | Plechner | F02B 33/10 | 123/193.1 |
| 6,729,290 | B1 * | 5/2004 | Rorke | F01L 11/02 | 123/193.6 |
| 8,251,025 | B2 * | 8/2012 | Riley | F02B 25/02 | 123/65 VC |
| 9,828,886 | B1 * | 11/2017 | Harmon, Sr. | F01L 31/00 | |
| 2008/0216480 | A1 * | 9/2008 | Harmon | F01K 11/00 | 60/670 |
| 2009/0205338 | A1 * | 8/2009 | Harmon, Sr. | F02G 5/02 | 60/677 |
| 2013/0037010 | A1 * | 2/2013 | Pattakos | F02B 75/32 | 123/73 AV |

(Continued)

*Primary Examiner* — Thomas N Moulis
(74) *Attorney, Agent, or Firm* — Mark David Torche; Patwrite Law

(57) ABSTRACT

An enhanced piston for improving the efficiency of an internal combustion engine has a cylinder with a combustion chamber and a lower cylinder portion. A cylinder head is disposed on the cylinder. An enhanced piston is moveably disposed within the cylinder and is connected to a piston rod. The enhanced piston has a piston cavity. There is an upper piston valve connected to an upper piston valve rod. The upper piston valve is disposed within the piston cavity wherein the upper piston valve selectively seals said piston cavity from the combustion chamber. A piston cavity port is disposed on a bottom portion of the piston cavity and is selectively opened and closed with a lower piston valve. The lower piston valve seals the piston cavity port from the lower cylinder portion. This way the gases are selectively sealed in the piston cavity under pressure until released in the combustion chamber.

20 Claims, 22 Drawing Sheets

(56) References Cited

U.S. PATENT DOCUMENTS

2017/0362972 A1* 12/2017 Mercier ..... F02P 5/06
2020/0004274 A1* 1/2020 Rowe ..... F16K 31/1225

* cited by examiner

ENHANCED PISTON FOR IMPROVING THE EFFICIENCY OF AN INTERNAL COMBUSTION ENGINE

BACKGROUND OF THE INVENTION

The internal combustion engine has a long history going back to the early eighteen hundreds until the present age where the internal combustion engine is a fixture of modern life. Throughout history, many improvements and advances have paved the way for our modern reliance on the ubiquitous internal combustion engine.

A common characteristic of most modern engines is the presence of a piston used to compress an air/fuel mixture and a combustion chamber where the fuel/air mixture is ignited. This results in a controlled explosion which forces the piston to move. The piston is generally connected to the crankshaft to turn the linear motion to rotary motion. These components and operation are common to both two and four stroke engines.

There is a need for an improved piston for an internal combustion engine that increases efficiency while retaining all the advantages of the modern internal combustion engine.

SUMMARY OF THE INVENTION

An enhanced piston for improving the efficiency of an internal combustion engine has a cylinder with a combustion chamber and a lower cylinder portion. A cylinder head is disposed on the cylinder. An enhanced piston is moveably disposed within the cylinder and is connected to a piston rod. The enhanced piston has a piston cavity. There is an upper piston valve connected to an upper piston valve rod. The upper piston valve is disposed within the piston cavity wherein the upper piston valve selectively seals said piston cavity from the combustion chamber. A piston cavity port is disposed on a bottom portion of the piston cavity and is selectively opened and closed with a lower piston valve. The lower piston valve seals the piston cavity port from the lower cylinder portion. This way the gases are selectively sealed in the piston cavity under pressure until released in the combustion chamber.

During operation, an fuel/air mixture is introduced either through valves or fuel injectors and near the end of the downstroke, the lower piston valve opens allowing the compressing fuel/air mixture to fill the cavity. At the start of the upward stroke, the lower piston valve closes. At the end of the upward stroke, the upper piston valve opens allowing the compressed air/fuel mixture to fill the combustion chamber for ignition.

Other features and advantages of the instant invention will become apparent from the following description of the invention which refers to the accompanying drawings.

DETAILED DESCRIPTION OF THE INVENTION

Figure 1:
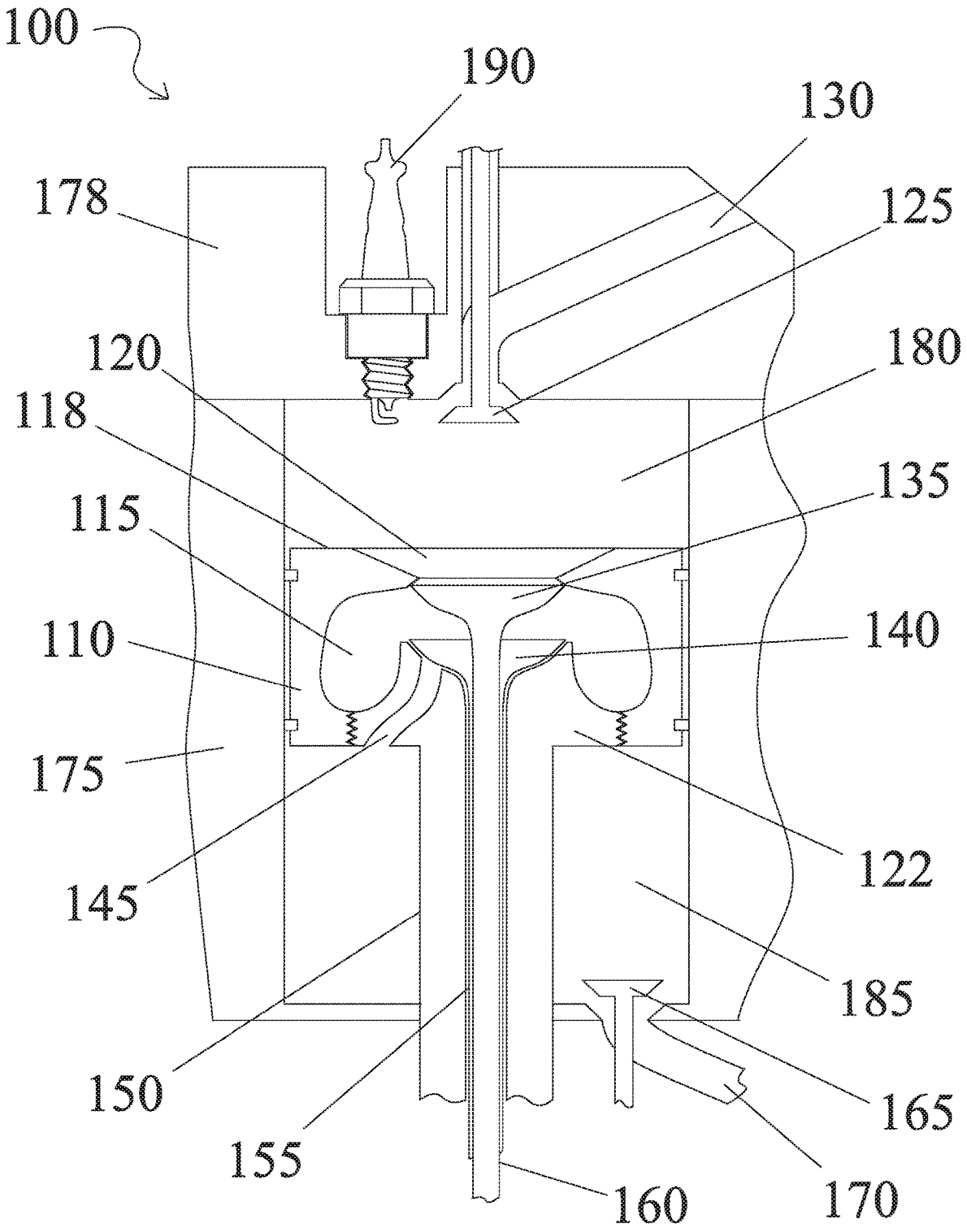
FIG. 1 is a cut-away view of an enhanced piston for improving the efficiency of an internal combustion engine according to an embodiment of the invention.

In the following detailed description of the invention, reference is made to the drawings in which reference numerals refer to like elements, and which are intended to show by way of illustration specific embodiments in which the invention may be practiced. It is understood that other embodiments may be utilized and that structural changes may be made without departing from the scope and spirit of the invention.

Referring to FIG. 1, an enhanced piston for improving the efficiency of an internal combustion engine 100 is shown having an enhanced piston 110 that moves within a cylinder block 175. Enhanced piston 110 has a piston cavity 115 disposed therein. An upper piston recessed portion 120 is disposed on an upper piston face 118. Piston recessed portion 120 is open to a combustion chamber 180. An upper piston valve 135 is used to selectively seal and unseal piston cavity 115 from combustion chamber 180. A lower piston valve 140 is provided to selectively seal and unseal piston cavity 115 from a lower cylinder portion 185. A piston cavity port 145 is used to connect piston cavity 115 with lower cylinder portion 185 when lower piston valve 140 is open.

A threaded portion 122 is threaded in a matching threaded portion in enhanced piston 110 to removably connect enhanced piston 110 to a piston rod 150. Piston rod 150 is hollow to allow a lower piston valve rod 155 and an upper piston valve rod 160 to fit within. Of course other methods of assembling the valves within piston cavity 115 such as welding piston rod 150 to enhanced piston 110 after valves are inserted within piston cavity 115 would be acceptable as long as the connection to the valves is secure and reliable. Lower cylinder portion 185 has a lower cylinder portion intake valve 165 located in a bottom portion of lower cylinder portion 185 and is used to seal off a lower cylinder portion intake port 170. Lower cylinder portion intake port 170 is used to bring in an air/fuel mixture to fill lower cylinder portion 185 during an intake cycle. An exhaust valve 125 is used to seal off an exhaust port 130 which is disposed in a cylinder head 178. Also disposed in cylinder head 178 is a spark plug 190.

In order to fit upper piston valve 135 and lower piston valve 140 within piston cavity 115, threaded portion 122 is unscrewed from enhanced piston 110 and then replaced once the valves are placed within. This allows piston cavity 115 to be selectively sealed by the timing of the valves opening and closing. The valves are controlled using standard timing systems such as camshafts, hydraulics or electronically controlled solenoids as is known in the art.

Referring to FIGS. 1 through 8, a typical cycle using enhanced piston for improving the efficiency of internal combustion engine 100, reference to FIGS. 1-8 will be described. In FIG. 1, enhanced piston 110 is shown with exhaust valve 125 open allowing the venting of gases from combustion chamber 180. Upper piston valve 135 and lower piston valve 140 are both closed sealing piston cavity 115. Lower cylinder portion intake valve 165 is open allowing air/fuel mixture to enter lower cylinder portion 185.

Figure 2:
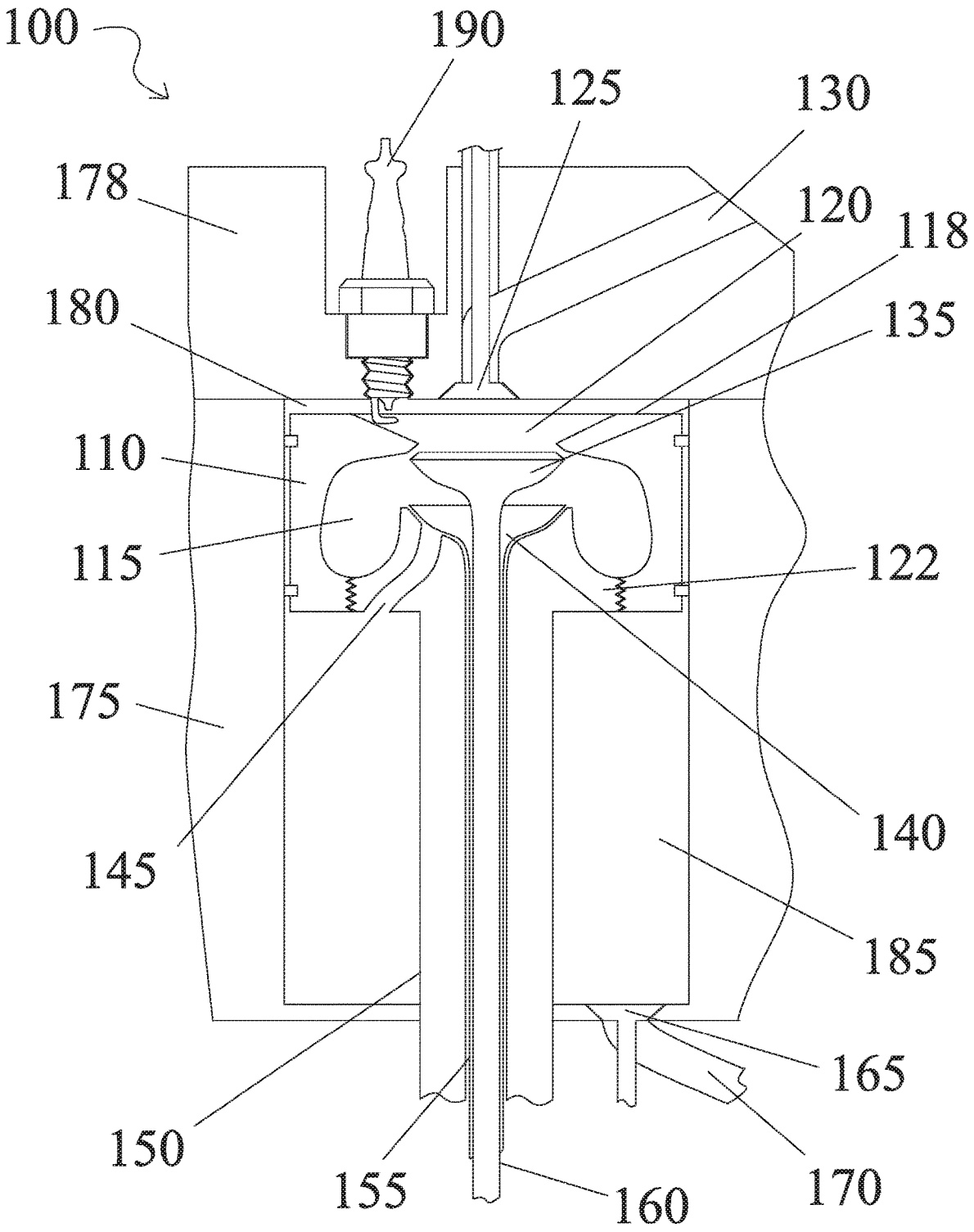
FIG. 2 is a cut-away view of the piston showed in FIG. 1 in a different position in the cycle.

Now referring to FIG. 2, enhanced piston 110 is basically at the top of the stroke with exhaust valve 125 closed and upper piston valve 135 starting to open. Lower piston valve 140 remains closed and lower cylinder portion intake valve 165 is closed.

Figure 3:
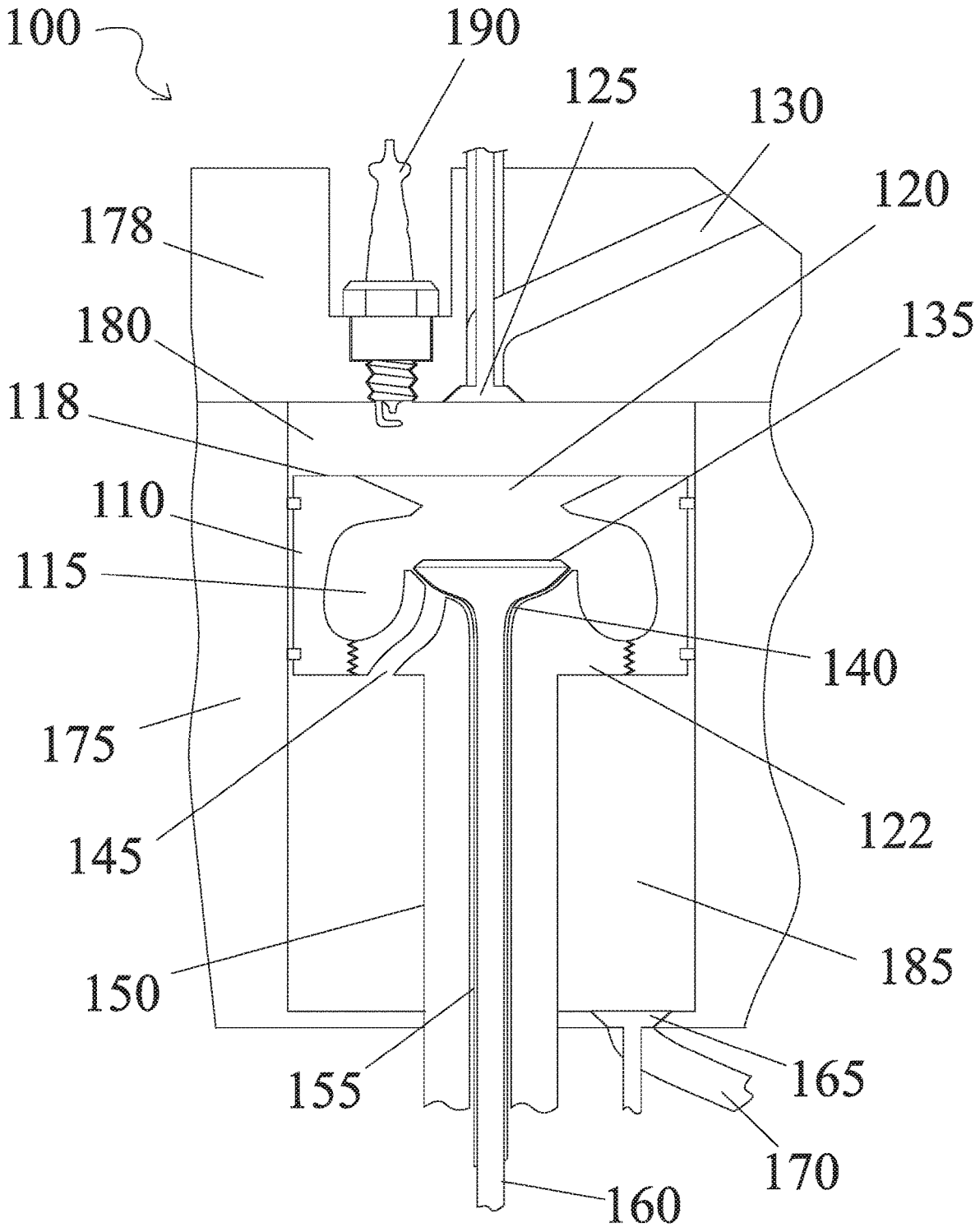
FIG. 3 is a cut-away view of the piston showed in FIG. 1 in a different position in the cycle.

Referring to FIG. 3, enhanced piston 110 is shown with upper piston valve 135 completely open and resting against lower piston valve 140. In this embodiment, upper piston valve 135 helps shield lower piston valve 140 from damage during ignition. Lower cylinder portion intake valve 165 is closed as well as exhaust valve 125.

Figure 4:
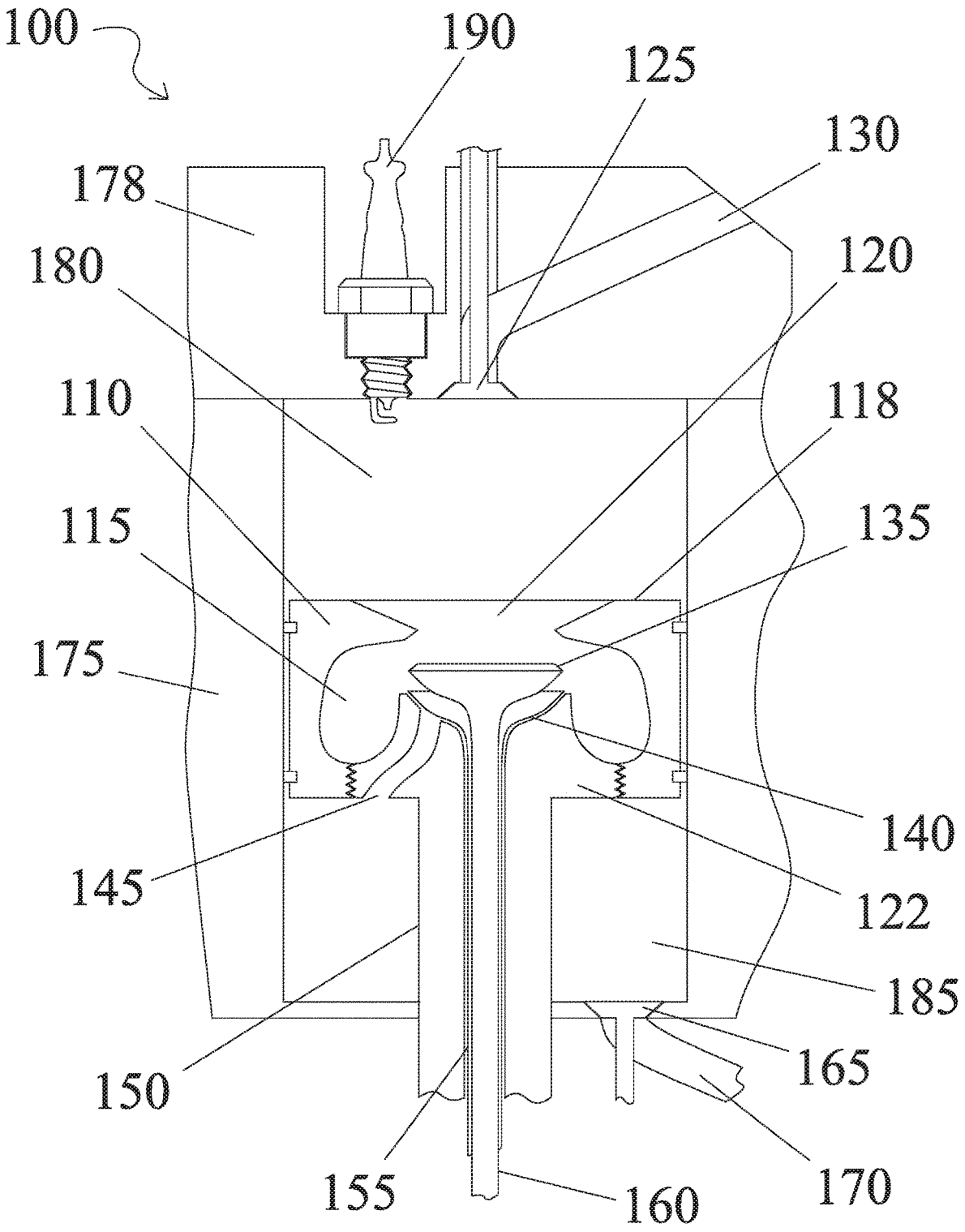
FIG. 4 is a cut-away view of the piston showed in FIG. 1 in a different position in the cycle.

Referring now to FIG. 4, lower cylinder portion intake valve 165 is closed as well as lower piston valve 140. The bottom of enhanced piston 110 compresses the air/fuel mixture of lower cylinder portion 185. Upper piston valve 135 is starting to close.

Figure 5:
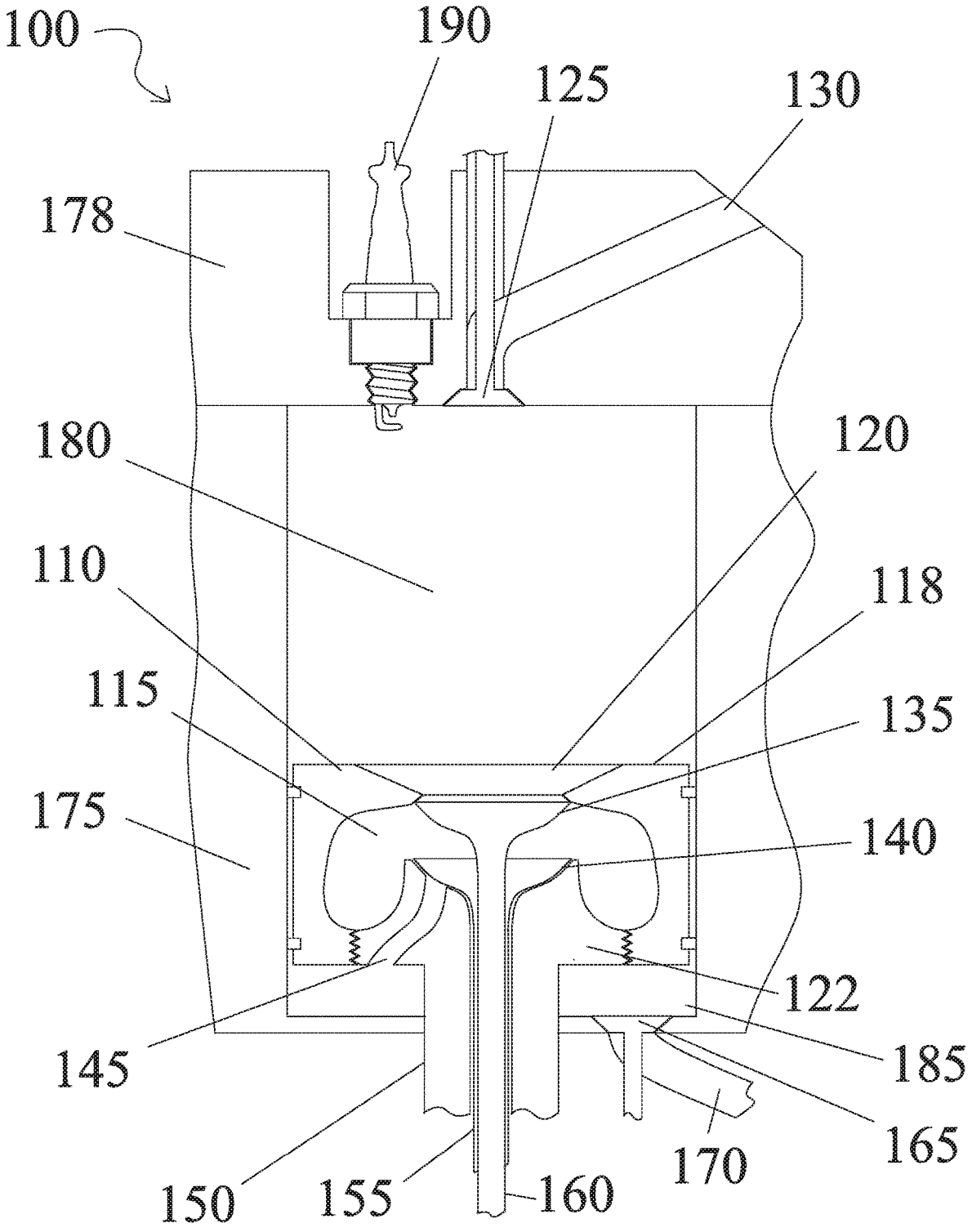
FIG. 5 is a cut-away view of the piston showed in FIG. 1 in a different position in the cycle.

Now referring to FIG. 5, the contents of lower piston portion 185 are compressed with lower cylinder portion intake valve 165 and lower piston valve 140 closed along with upper piston valve 135 and exhaust valve 125. Of course it is possible to have exhaust valve 125 open to reduce pressure to ensure that the piston does not attempt to pressurize the exhaust gas during the soon to start up stroke. This practice is called "blowdown" in the art.

Figure 6:
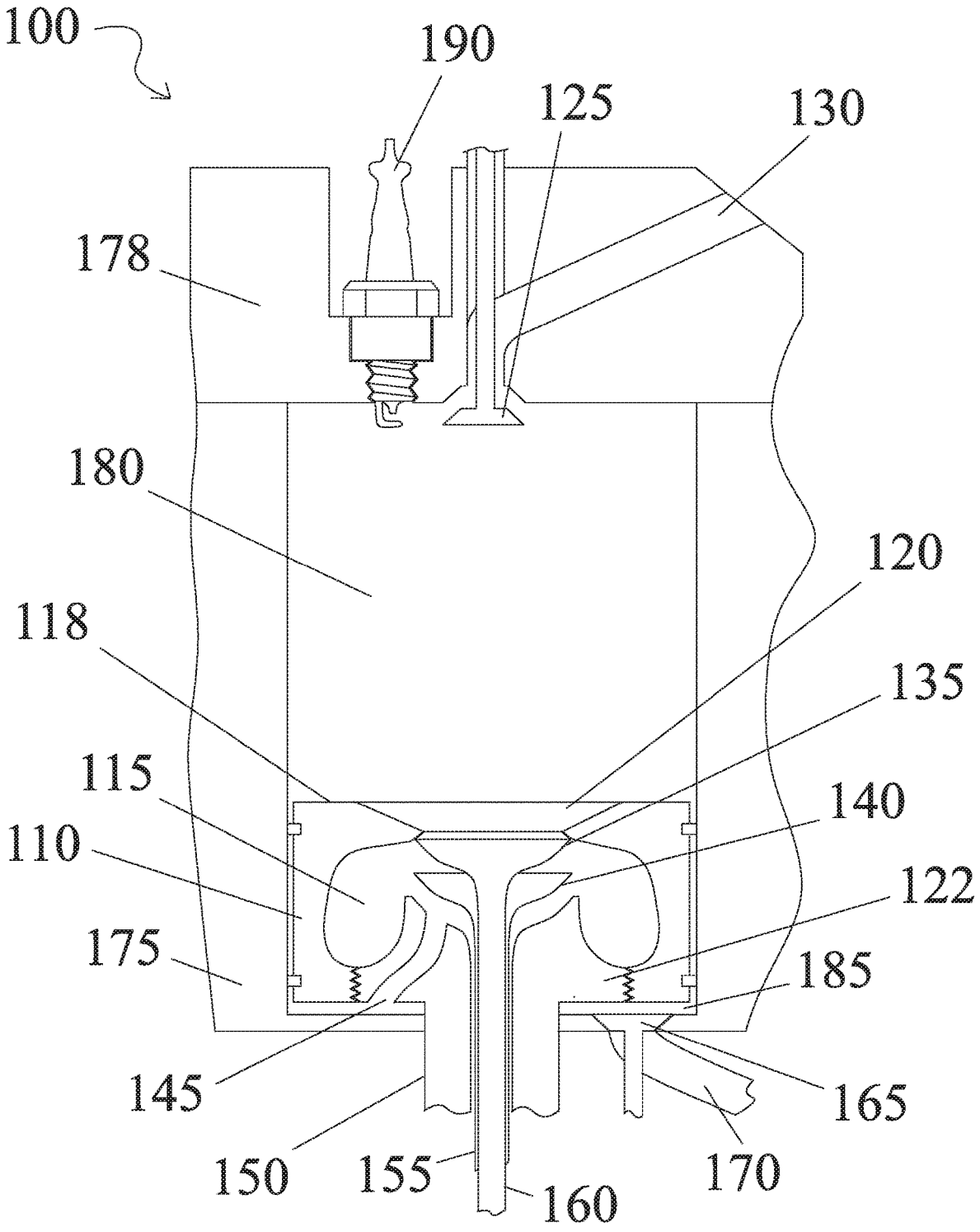
FIG. 6 is a cut-away view the piston showed in FIG. 1 in a different position in the cycle.

Referring to FIG. 6, enhanced piston 110 is now at the bottom of the stroke and lower piston valve 140 is now open allowing the compressed gas to fill piston cavity 115 and to store the compressed gas within since upper piston valve 135 is closed. Exhaust valve 125 is now open allowing exhaust gases to vent.

Figure 7:
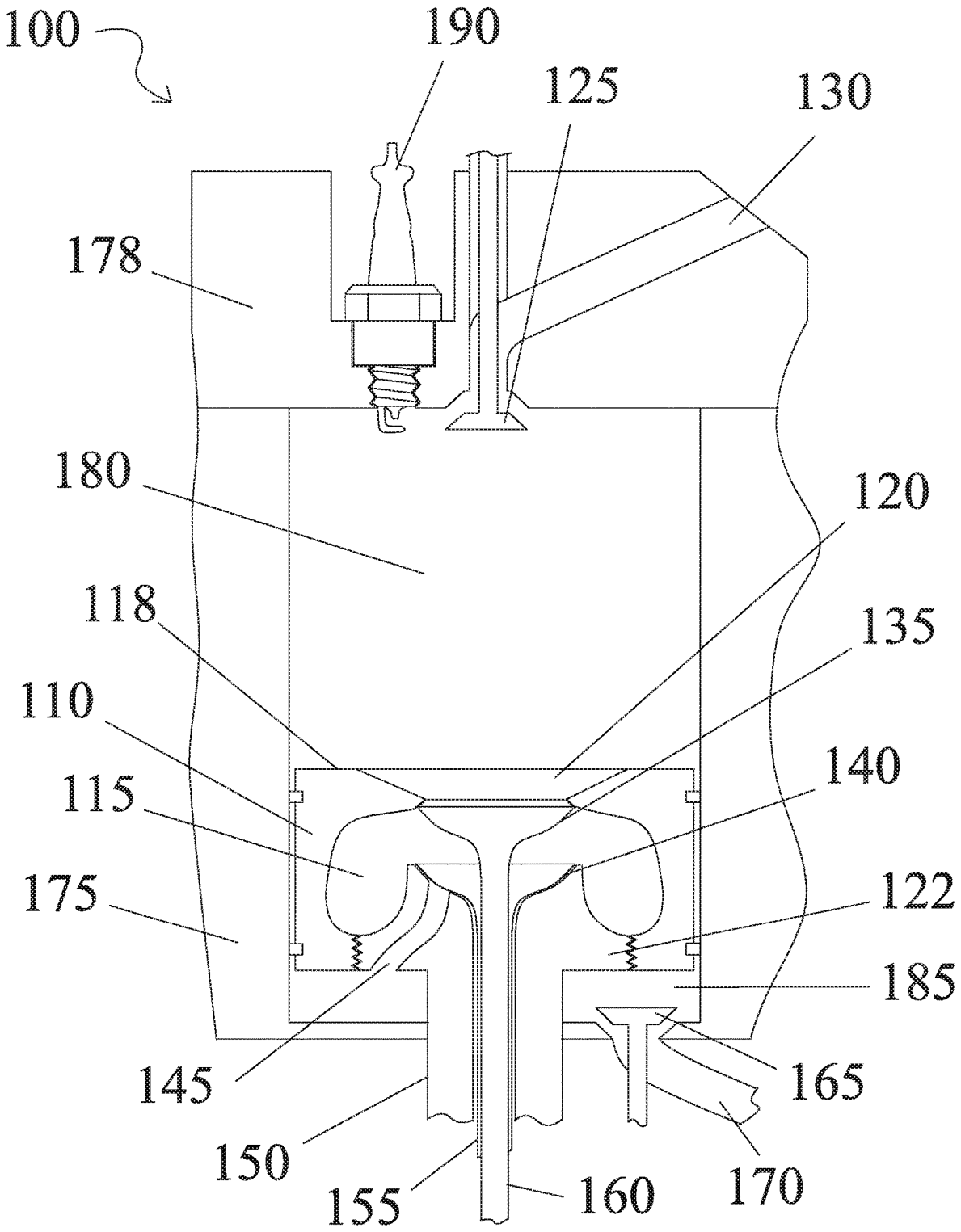
FIG. 7 is a cut-away view of the piston showed in FIG. 1 in a different position in the cycle.

Referring now to FIG. 7, the stored compressed fuel air/mixture is fully contained within piston cavity 115 by having both upper and lower piston valves 135 and 140 closed. Lower cylinder portion intake valve 165 is now opening. Exhaust valve 125 is still open.

Figure 8:
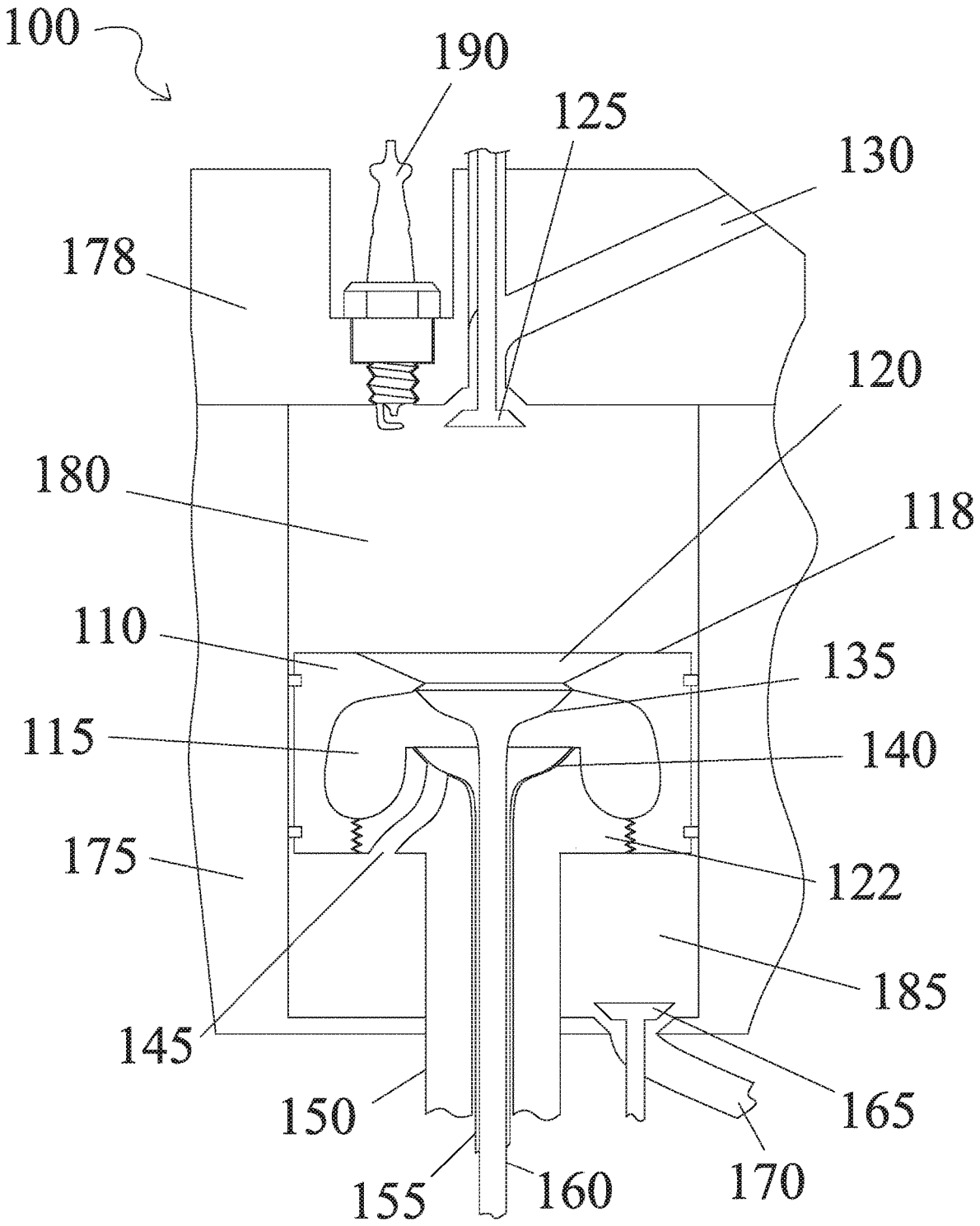
FIG. 8 is a cut-away view of the piston showed in FIG. 1 in a different position in the cycle.

Now referring to FIG. 8, the compressed air/fuel mixture is stored within piston cavity 115 while fresh air/fuel mixture is being introduced through lower cylinder portion intake valve 165 and exhaust gases are ejected through open exhaust valve 125. As enhanced piston 110 reaches the top of the stroke, upper piston valve 135 opens and spark plug 190 ignites the compressed air/fuel mixture as the cycle repeats. The process of compressing the air/fuel mixture on the downward stroke of the cycle greatly enhances the efficiency of the engine.

Figure 9:
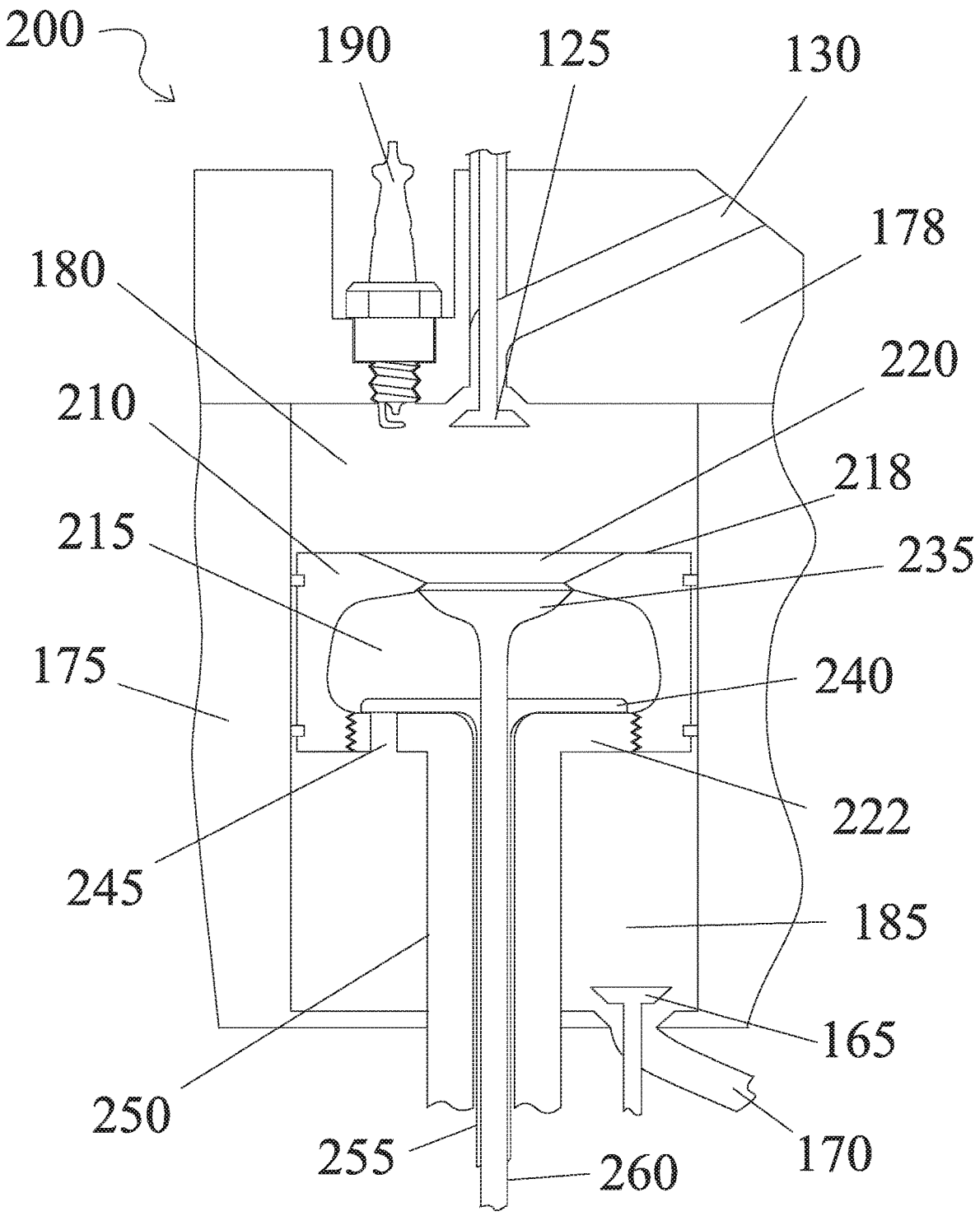
FIG. 9 is a cut-away view of an enhanced piston for improving the efficiency of an internal combustion engine having an alternative valve location and geometry according to an embodiment of the invention.

Referring to FIG. 9, an enhanced piston for improving the efficiency of an internal combustion engine 200 is shown having an enhanced piston 210 with a piston cavity 215 that has a different geometry from the one shown in FIGS. 1-8; however, the functionality is generally the same. As shown, a lower piston valve 240 is basically flat which closes off a piston cavity port 245. An upper piston valve 235 is basically the same as discussed above and is used to seal off an upper piston recessed portion 220 from piston cavity 215. Upper piston recessed portion 220 is disposed on an upper piston face 218.

Similar to the embodiment shown in FIGS. 1-8, a piston rod 250 is hollow and encloses a lower piston valve rod 255 and an upper piston valve rod 260. Again in order to allow for insertion of upper piston valve 235 and lower piston valve 240, piston rod 250 has a threaded portion 222 that removably fits within a matching threaded portion of enhanced piston 210. This embodiment utilizes a less complex piston cavity geometry than the embodiment shown in FIGS. 1-8. Of course other geometries would be acceptable as long they provide a sealable cavity within the piston.

Lower piston valve 240 is basically flat to close off and seal piston cavity port 245. Other valve configuration are possible as should be clear from the drawings as long as the piston cavity is sealable.

Figure 10:
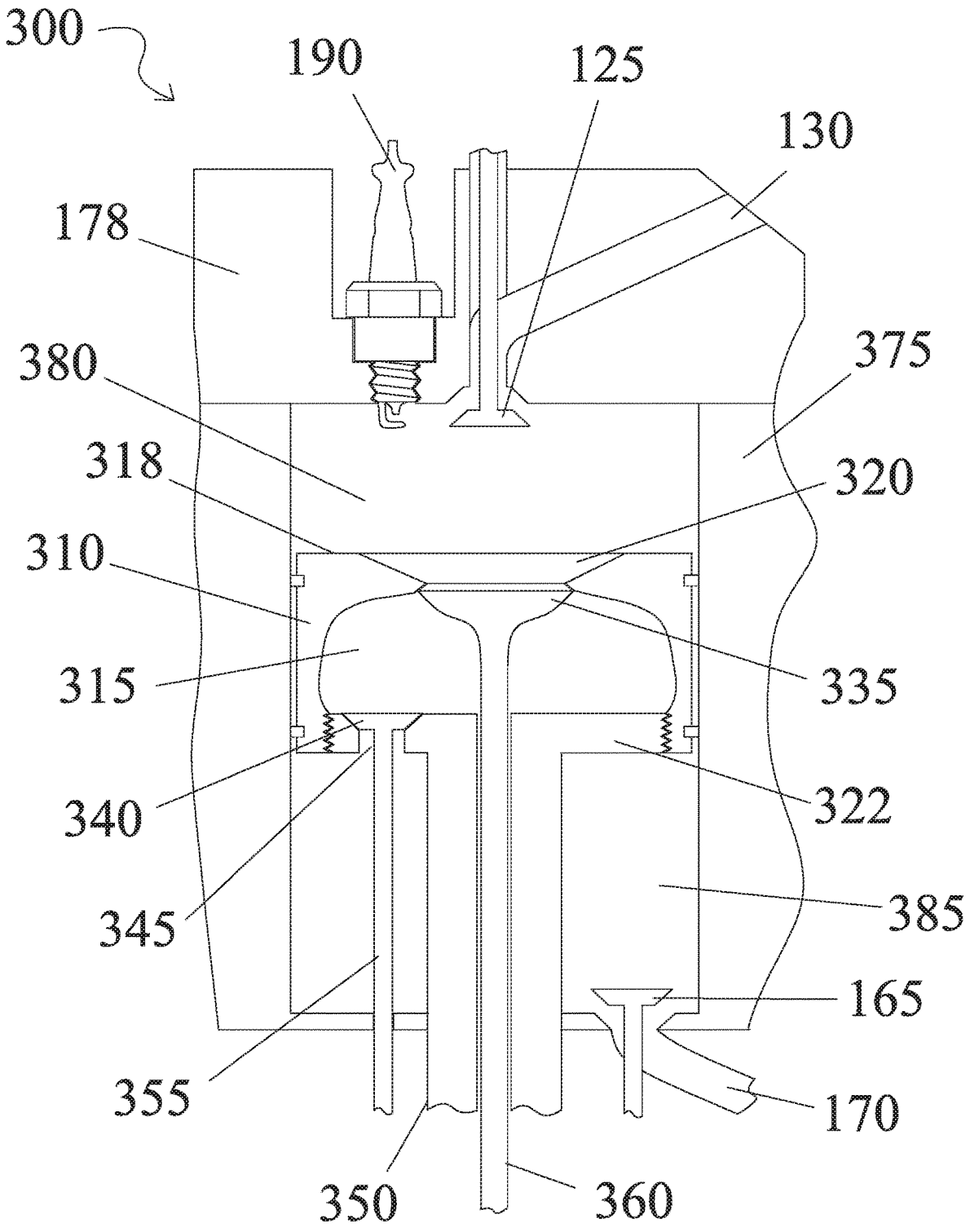
FIG. 10 is a cut-away view of an enhanced piston for improving the efficiency of an internal combustion engine having an alternative valve location according to an embodiment of the invention.

Referring now to FIG. 10, an enhanced piston for improving the efficiency of an internal combustion engine 300 is shown having an enhanced piston 310. Enhanced piston 310 has a piston cavity 315 and an upper piston recessed portion 320. Upper piston recessed portion 320 is disposed on an upper piston face 318. Enhanced piston 310 is moveably disposed within a cylinder block 375 and a lower cylinder portion 385 and a combustion chamber 380. A lower piston valve 340 selectively seals a piston cavity port 345. A lower piston valve rod 355 is used to activate lower piston valve 340. A piston rod 350 has a threaded portion 322 which is used to allow an upper piston valve 335 and an upper piston valve rod 360 to be placed within piston cavity 315 as discussed above. The difference between this embodiment and the one shown in FIG. 9 is that lower piston valve rod 355 is not contained within the piston rod. The valves are controlled using standard timing systems which can be camshafts, hydraulics or electrically controlled solenoids as discussed above.

Figure 11:
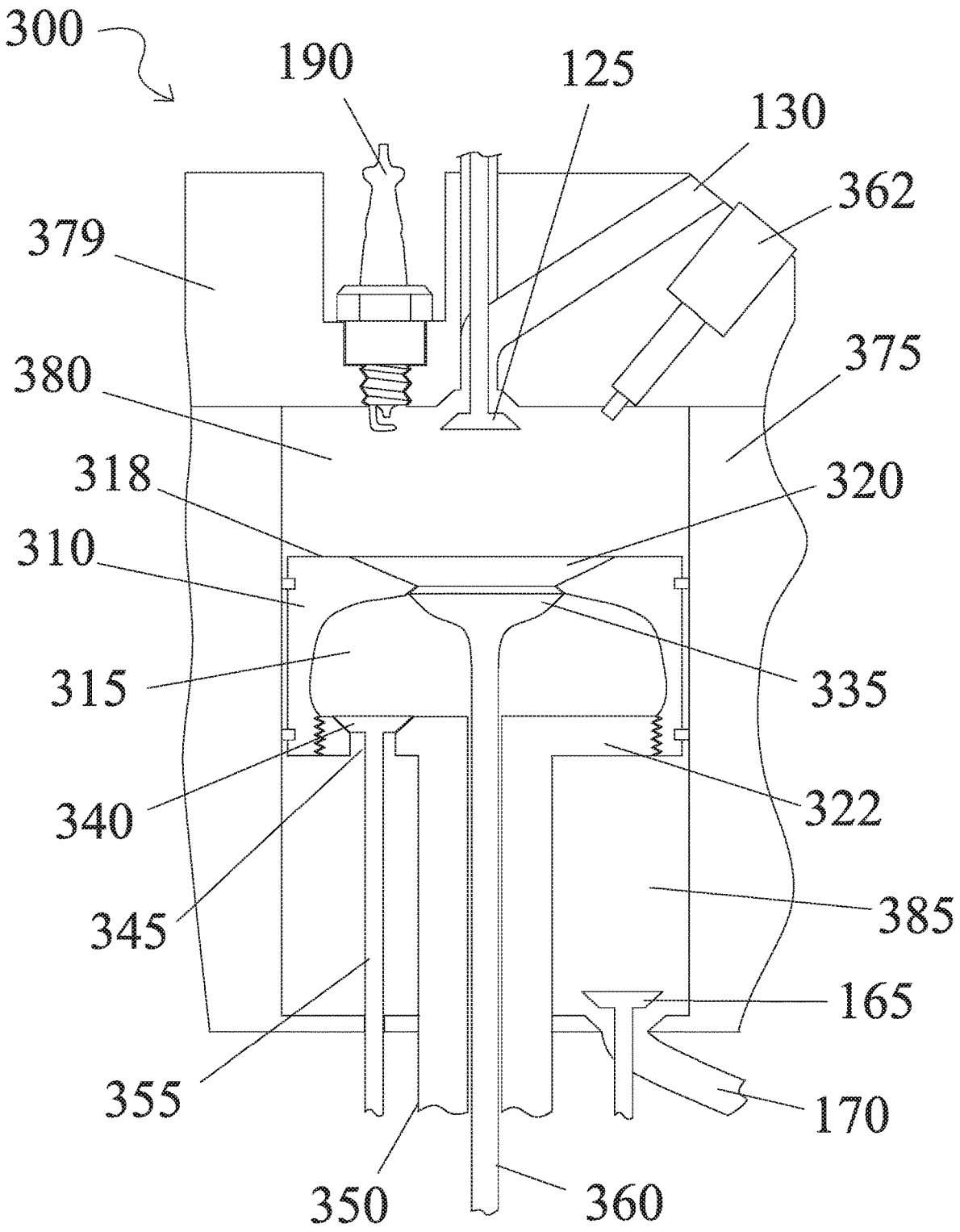
FIG. 11 is a cut-away view of an enhanced piston for improving the efficiency of an internal combustion engine shown in FIG. 10 with a fuel injector.

Referring to FIG. 11, an upper fuel injector 362 is disposed in a cylinder head 379 and is used to inject fuel into combustion chamber 380 in addition to the air fuel mixture that is introduced through lower cylinder portion intake valve 165.

Figure 12:
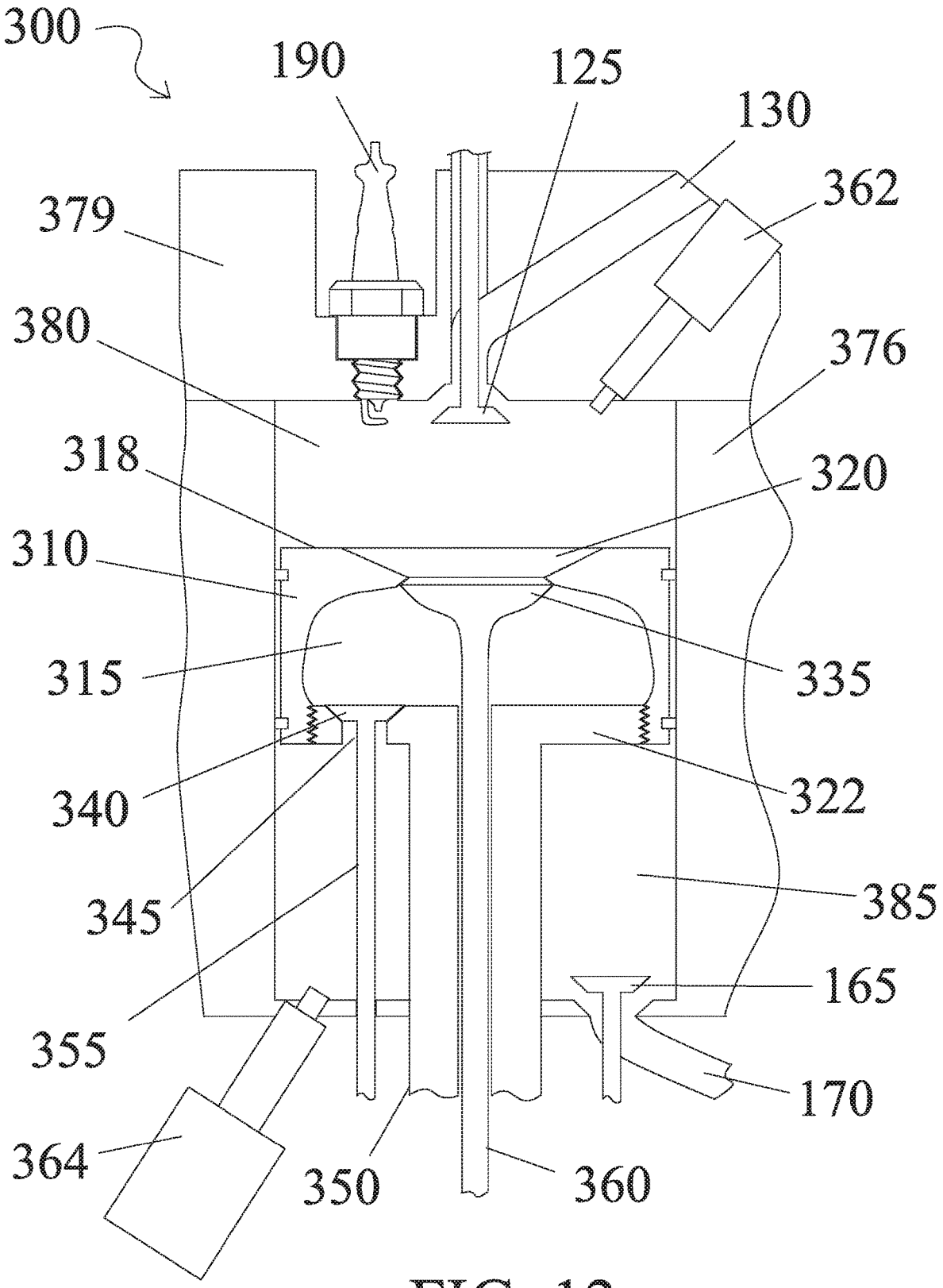
FIG. 12 is a cut-away view of the enhanced piston for improving the efficiency of an internal combustion engine shown in FIG. 11 having a second fuel injector.

Now referring to FIG. 12, an embodiment showing the use of upper fuel injector 362 and a lower fuel injector 364 to inject fuel into both combustion chamber 380 and lower cylinder portion 385. Lower fuel injector 364 is disposed in a cylinder block 376. In this embodiment, lower cylinder portion intake valve 165 is only used to introduce air rather than the air/fuel mixture as used in some of the embodiments above. It should be clear that only one fuel injector, either upper fuel injector 362 or lower fuel injector 364 is needed for operation. This would allow the instant invention to operate since in either case fuel will be available in combustion chamber 380 which will be ignited by spark plug 190. It is also possible to use a combination of fuel injectors and other fuel delivery devices to deliver the air/fuel mixture to the engine through lower cylinder portion intake valve 165.

Figure 13:
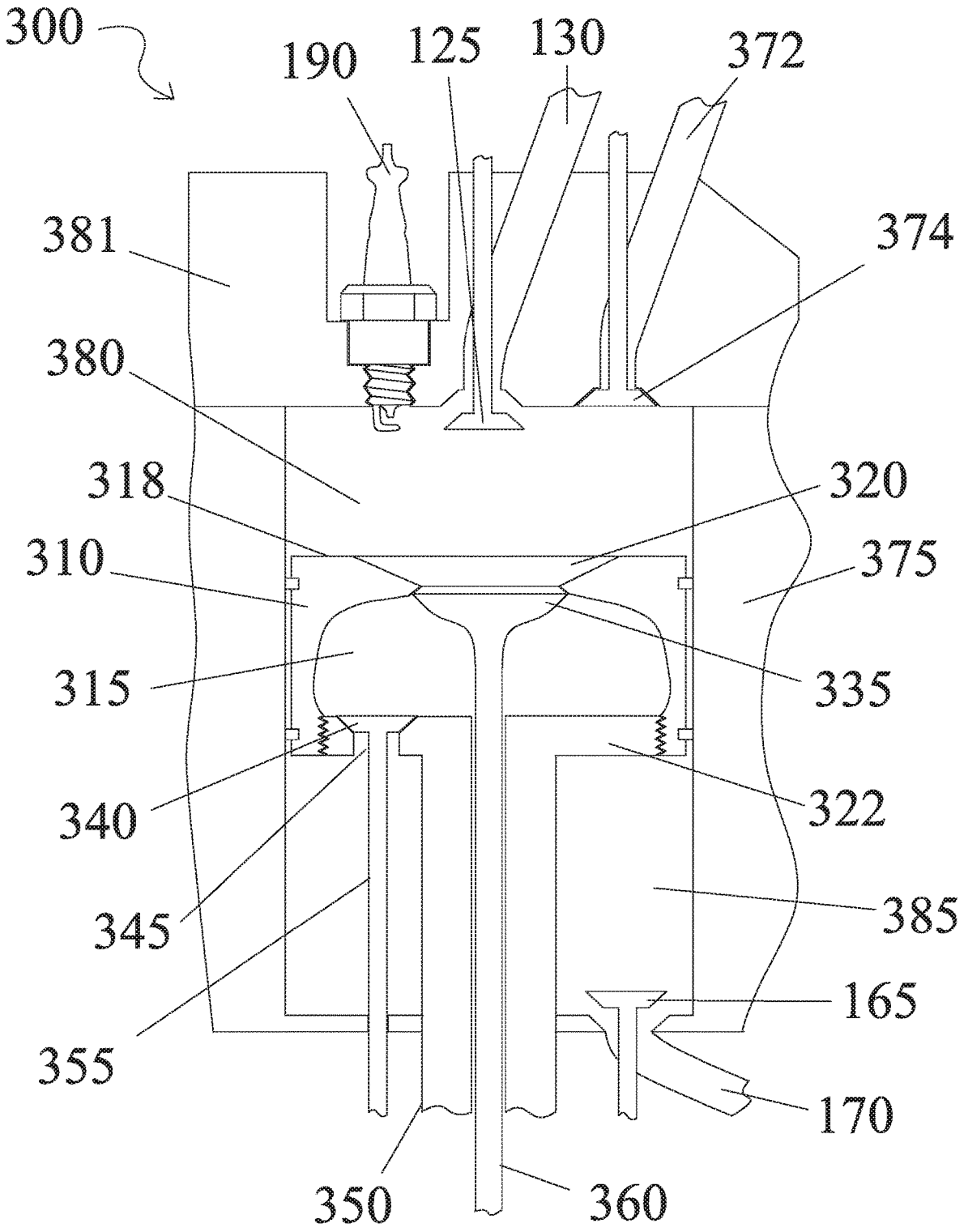
FIG. 13 is a cut-away view of the enhanced piston for improving the efficiency of an internal combustion engine shown in FIG. 10 with an additional intake valve.

Referring to FIG. 13, an upper intake port 372 and an upper intake valve 374 is used to introduce moderately compressed air into combustion chamber 380 and are disposed in a cylinder head 381. In this embodiment, if upper intake valve 374 is open while exhaust valve 125 is partly open, then this helps remove the remaining exhaust from the cylinder. Also, if any fresh air escapes through exhaust port 130, this can help clean the exhaust gas by oxidizing any unburned fuel or reactants such as carbon monoxide.

Figure 14:
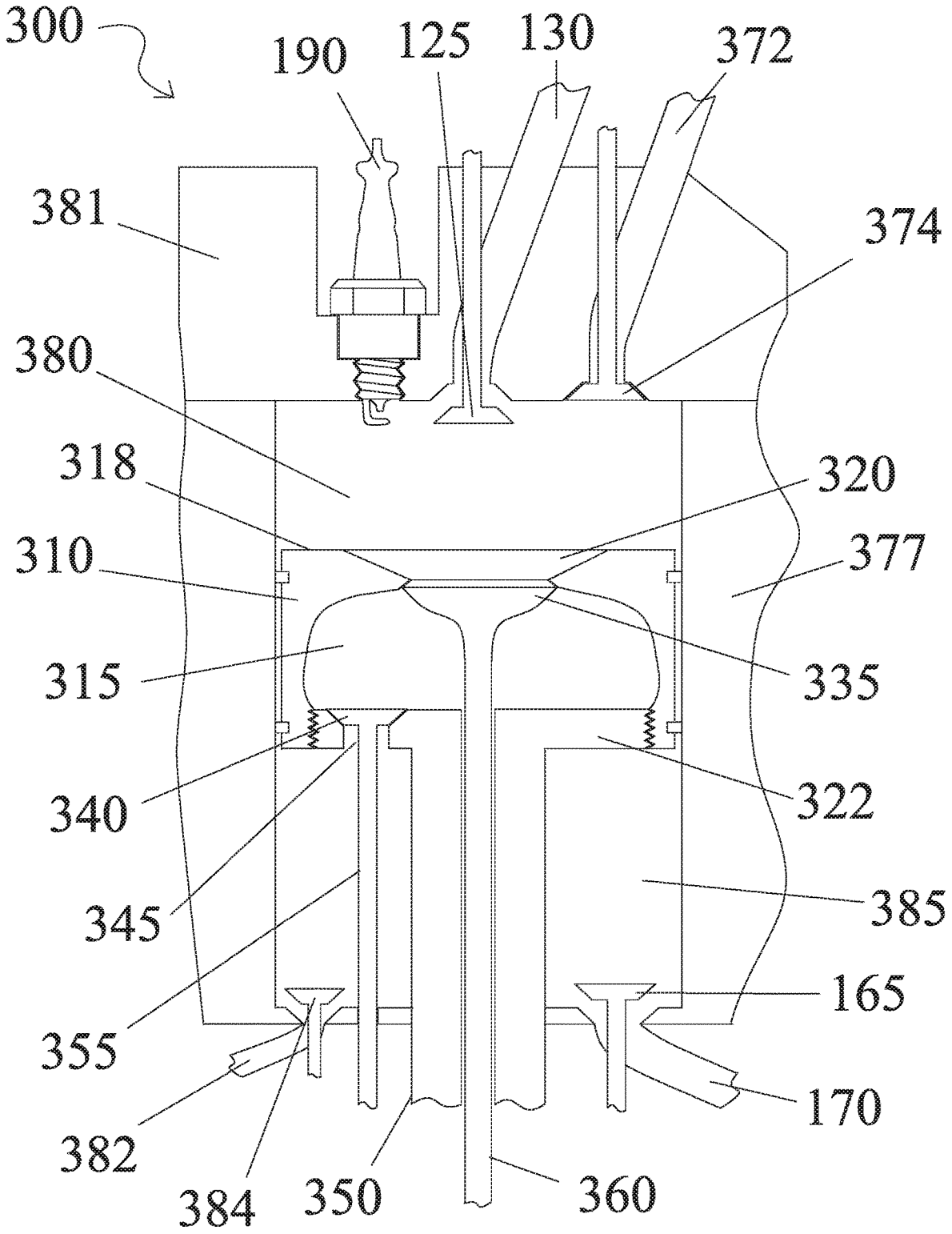
FIG. 14 is a cut-away view of the enhanced piston for improving the efficiency of an internal combustion engine shown in FIG. 13 having an additional valve.

Referring now to FIG. 14, a lower fuel port 382 and a lower cylinder portion intake fuel valve 384 are disposed in a cylinder block 377 and are used to introduce fuel separately from lower cylinder portion intake port 170 to lower cylinder portion 385. In this embodiment, lower cylinder portion intake port 170 is only used to introduce air and not an air/fuel mixture.

Figure 15:
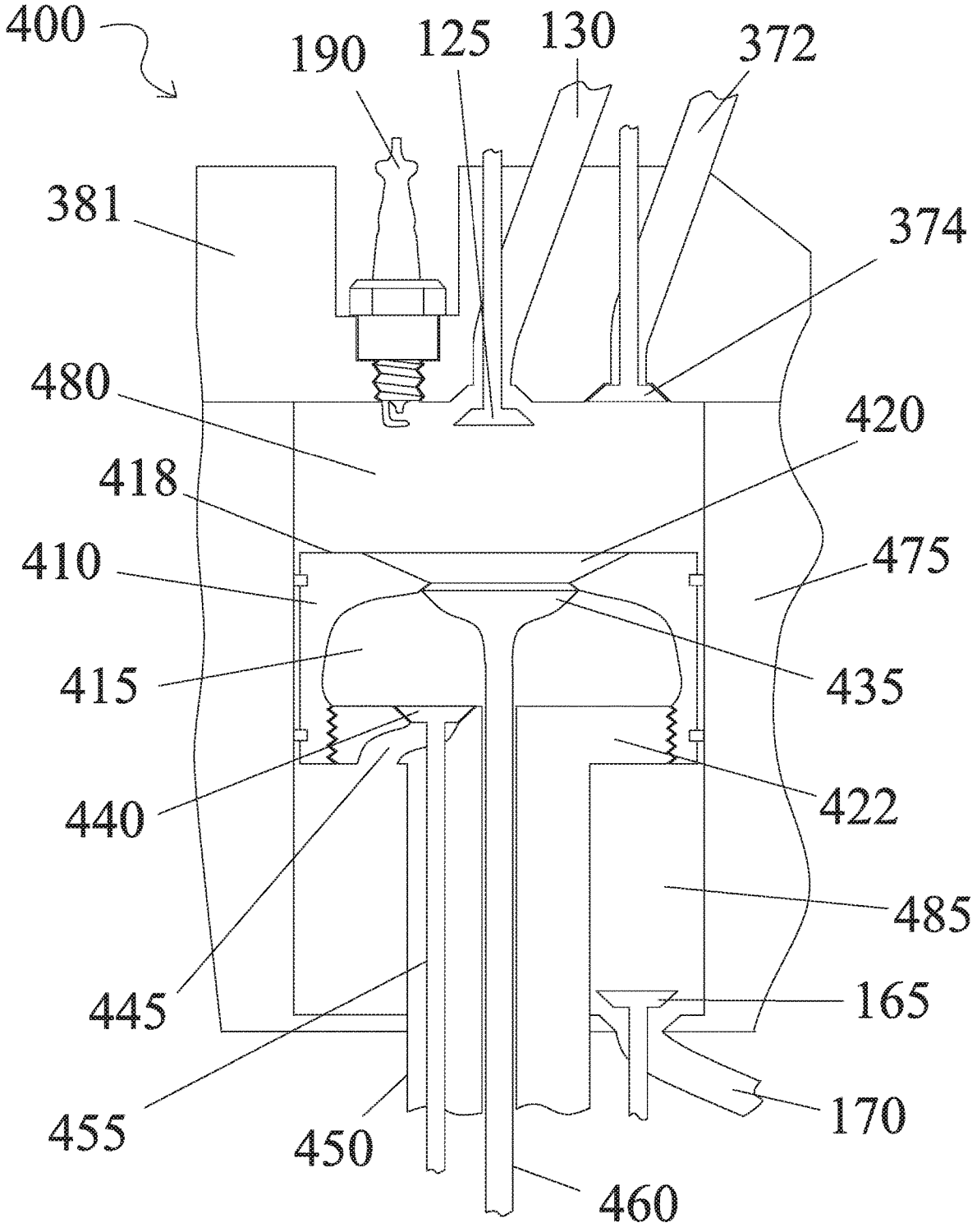
FIG. 15 is a cut-away view of the enhanced piston for improving the efficiency of an internal combustion engine having an alternative piston cavity port geometry according to an embodiment of the invention.

Now referring to FIG. 15, an enhanced piston for improving the efficiency of an internal combustion engine 400 is shown with an enhanced piston 410 which has a piston cavity 415. Enhanced piston 410 is moveably disposed within a cylinder block 475 with a combustion chamber 480 above and a lower cylinder portion 485 below. Piston cavity 415 has a simple geometry compared to the embodiment shown in FIG. 1. In this embodiment, a piston rod 450 encloses a lower piston valve rod 455 and an upper piston valve rod 460. Enhanced piston 410 has an upper piston recessed portion 420 which is disposed in an upper piston face 418. An upper piston valve 435 is provided to seal off piston cavity 415 from combustion chamber 480. Enhanced piston 410 has a threaded portion 422 to provide assembly of upper piston valve 435 and a lower piston valve 440 as discussed above. A piston cavity port 445 provides a channel to selectively connect piston cavity 415 to lower cylinder portion 485.

Figure 16:
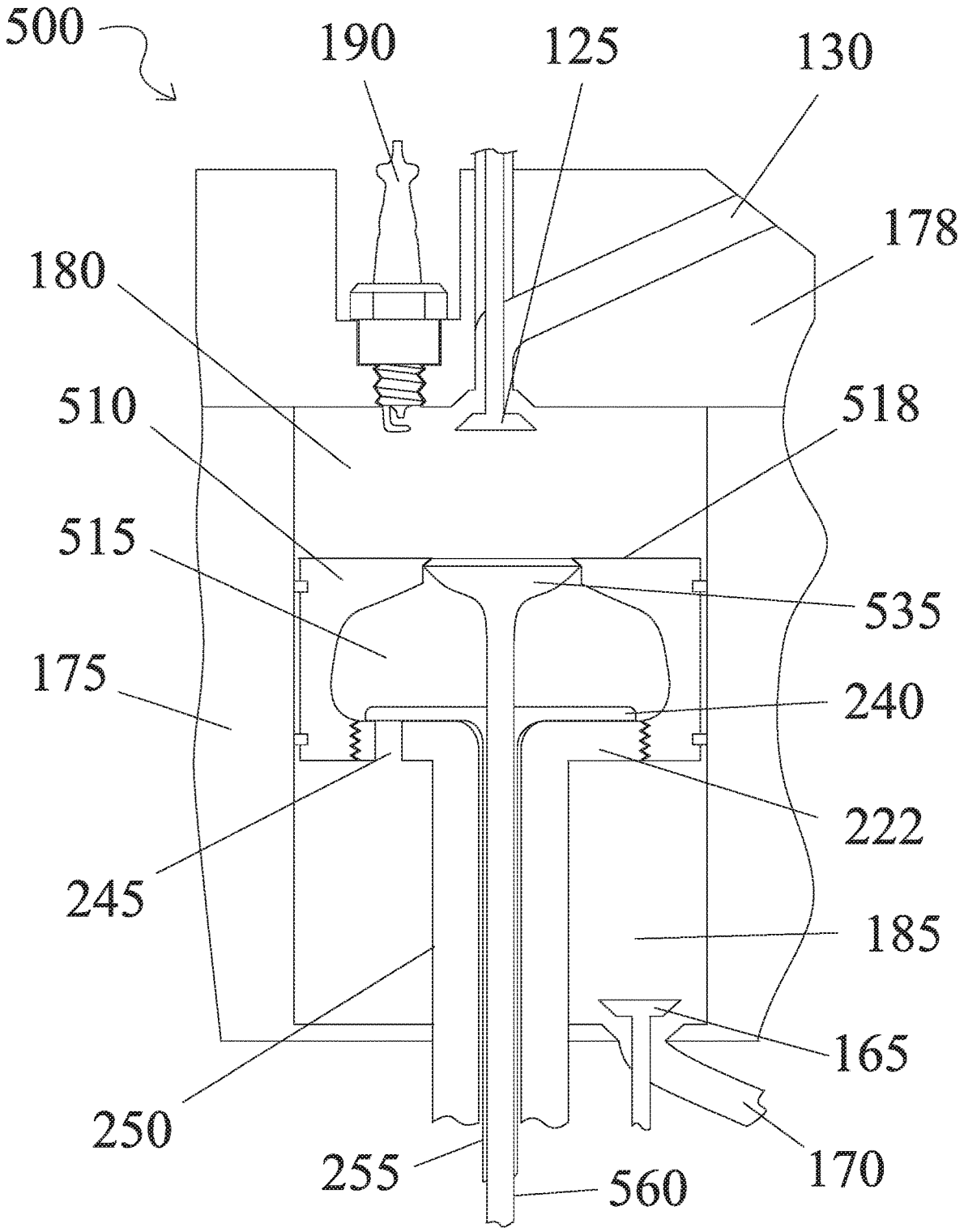
FIG. 16 is a cut-away view of the enhanced piston for improving the efficiency of an internal combustion engine according to an embodiment of the invention.

Referring to FIG. 16, an enhanced piston for improving the efficiency of an internal combustion engine 500 is shown with an enhanced piston 510 which has a piston cavity 515. In this embodiment, enhanced piston 510 has an upper piston face 518 that is generally flat. An upper piston valve 535 is disposed on an upper piston valve rod 560 which is used to selectively seal and unseal piston cavity 515 from combustion chamber 180.

Figure 17:
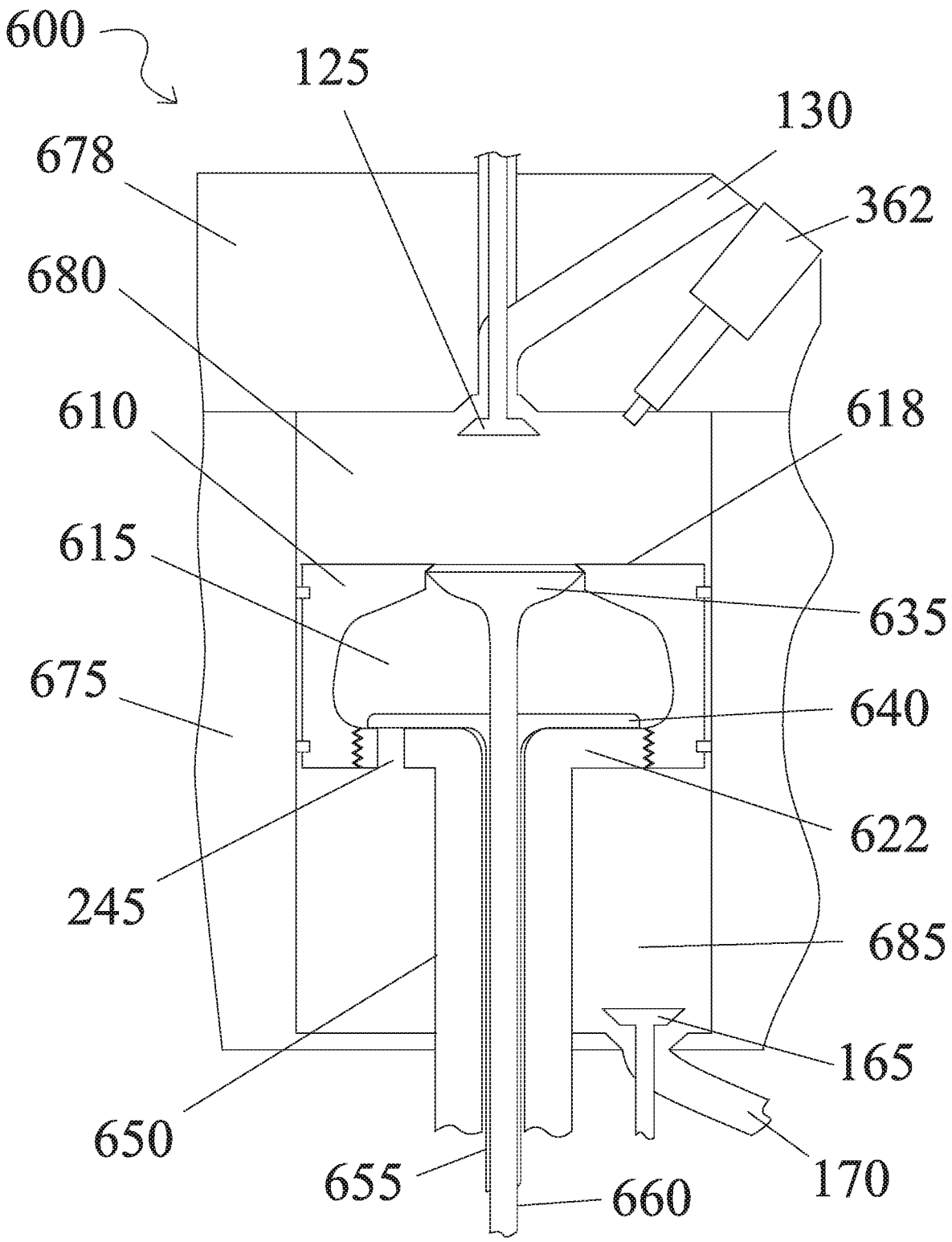
FIG. 17 is a cut-away view of the enhanced piston for improving the efficiency of an internal combustion for use in a diesel engine having an alternate fuel intake according to an embodiment of the invention.

Referring now to FIG. 17, an enhanced piston for improving the efficiency of an internal combustion engine 600 is adapted for use in a diesel cycle engine and is shown with an enhanced piston 610 which has a piston cavity 615. Enhanced piston 610 is moveably disposed within a cylinder block 675, a cylinder head 678 and a lower cylinder portion 685. In this embodiment, while enhanced piston 610 has an upper piston face 618 that is essentially flat; it would be possible to incorporate a recessed portion as discussed above (see FIG. 1 for example 1). Enhanced piston 610 has a piston rod 650 with a threaded portion 622 to allow for insertion of a lower piston valve 640 connected to a lower piston valve rod 655 and an upper piston valve 635 connected to an upper piston valve rod 660. In this embodiment, there is no spark plug since it is not needed in a diesel engine and the air/fuel mixture is ignited within a combustion chamber 680 when the compression reaches ignition temperature. Of course if another type of fuel is introduced into the cylinder; either through an intake valve or fuel injector, that fuel would also start burning when diesel fuel is injected into the cylinder, thus functioning as a dual fuel engine.

Figure 18:
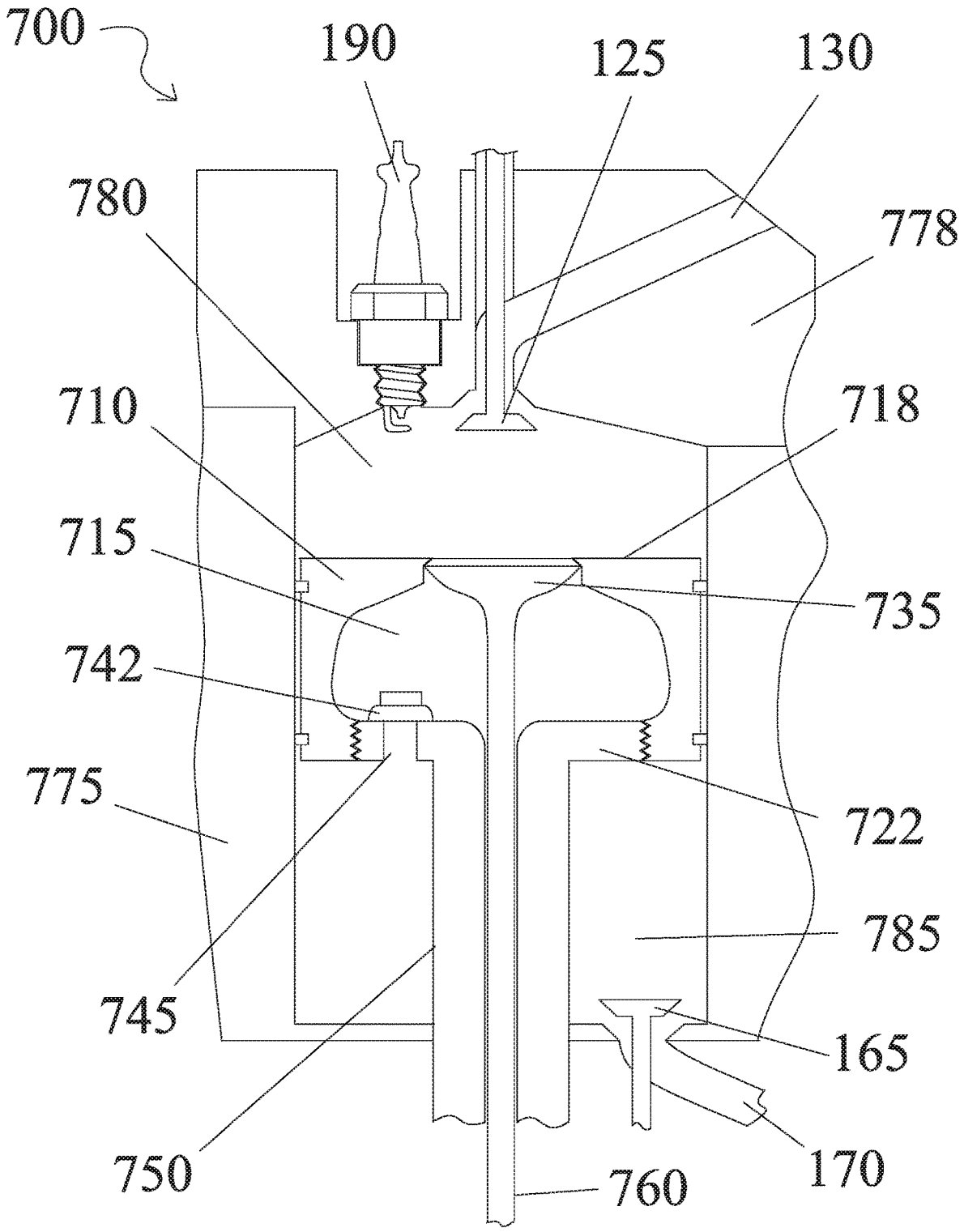
FIG. 18 is a cut-away view of the enhanced piston for improving the efficiency of an internal combustion engine according to an embodiment of the invention.

Now referring to FIG. 18, an enhanced piston for improving the efficiency of an internal combustion engine 700 is shown having an enhanced piston 710 having a piston cavity 715 and an upper piston face 718. Enhanced piston 710 is moveably disposed within a cylinder block 775, cylinder head 778, combustion chamber 780 and a lower cylinder portion 785. Piston cavity 715 has a one way valve 742 installed in a piston cavity port 745 to allow gases to enter from lower cylinder portion 785 but not flow back through piston cavity port 745. An upper piston valve 735 is connected to an upper piston valve rod 760 and is enclosed in a piston rod 750. Piston rod 750 has a threaded portion 722 similar to the threaded portions discussed above. This embodiment eliminates the need for a valve rod on the valve used to seal off piston cavity port 745.

Figure 19:
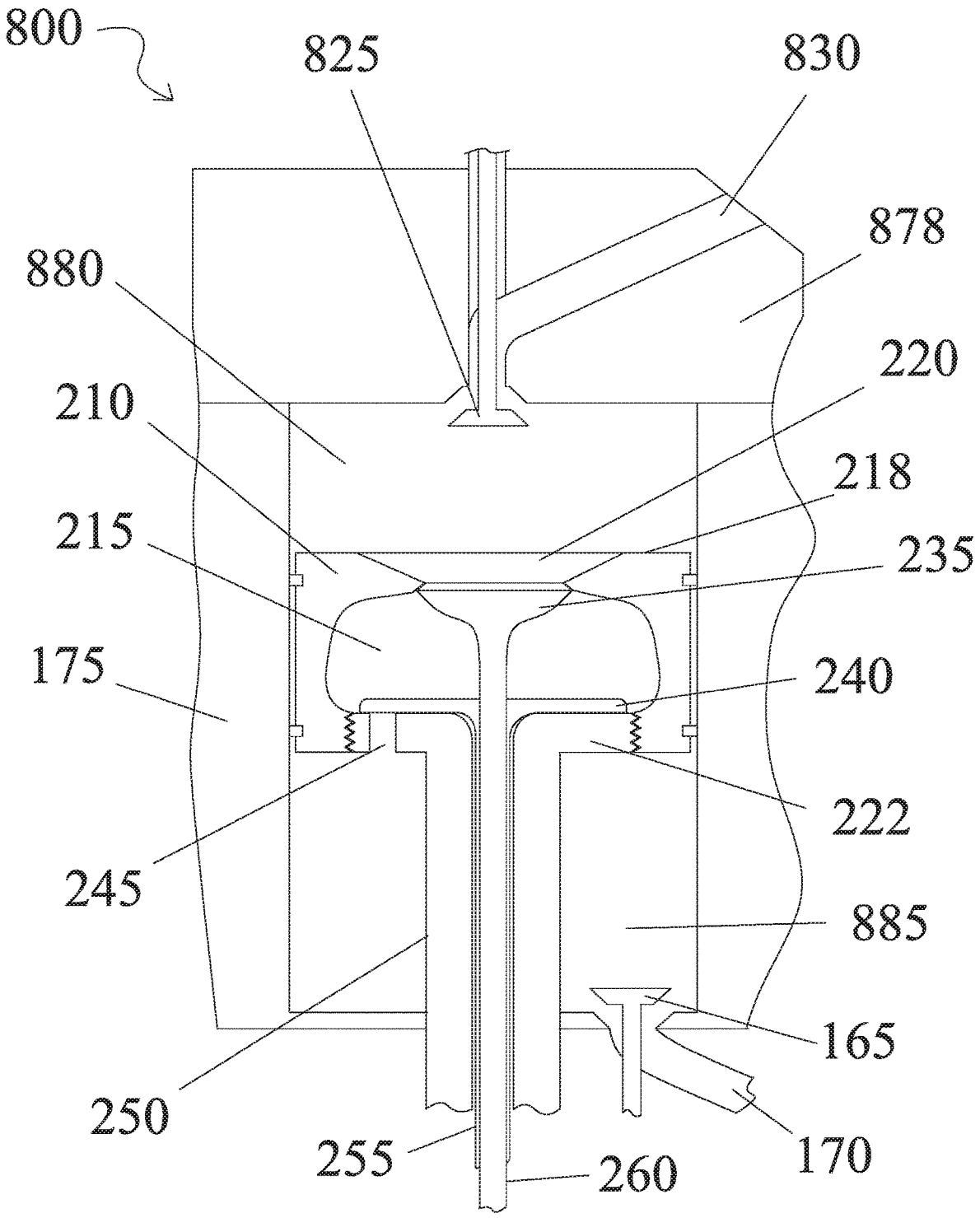
FIG. 19 is a cutaway view of an enhanced piston for improving the efficiency of an internal combustion engine using a dieseling cycle according to an embodiment of the invention.

Referring to FIG. 19, an enhanced piston for improving the efficiency of an internal combustion engine 800 is adapted for use in an engine using a dieseling cycle and is shown with enhanced piston 210 which has piston cavity 215 moveably disposed within cylinder block 175 with a combustion chamber 880 and a lower cylinder portion 885. A cylinder head 878 has an exhaust valve 825 that is used to control exhaust gases removed through an exhaust port 830 after being burned in combustion chamber 880. In this embodiment, fuel is introduced through lower cylinder portion intake valve 165. Of course other means to introduce fuel and or air may be used with the present invention as should be understood to be within the scope of the disclosure.

Figure 20:
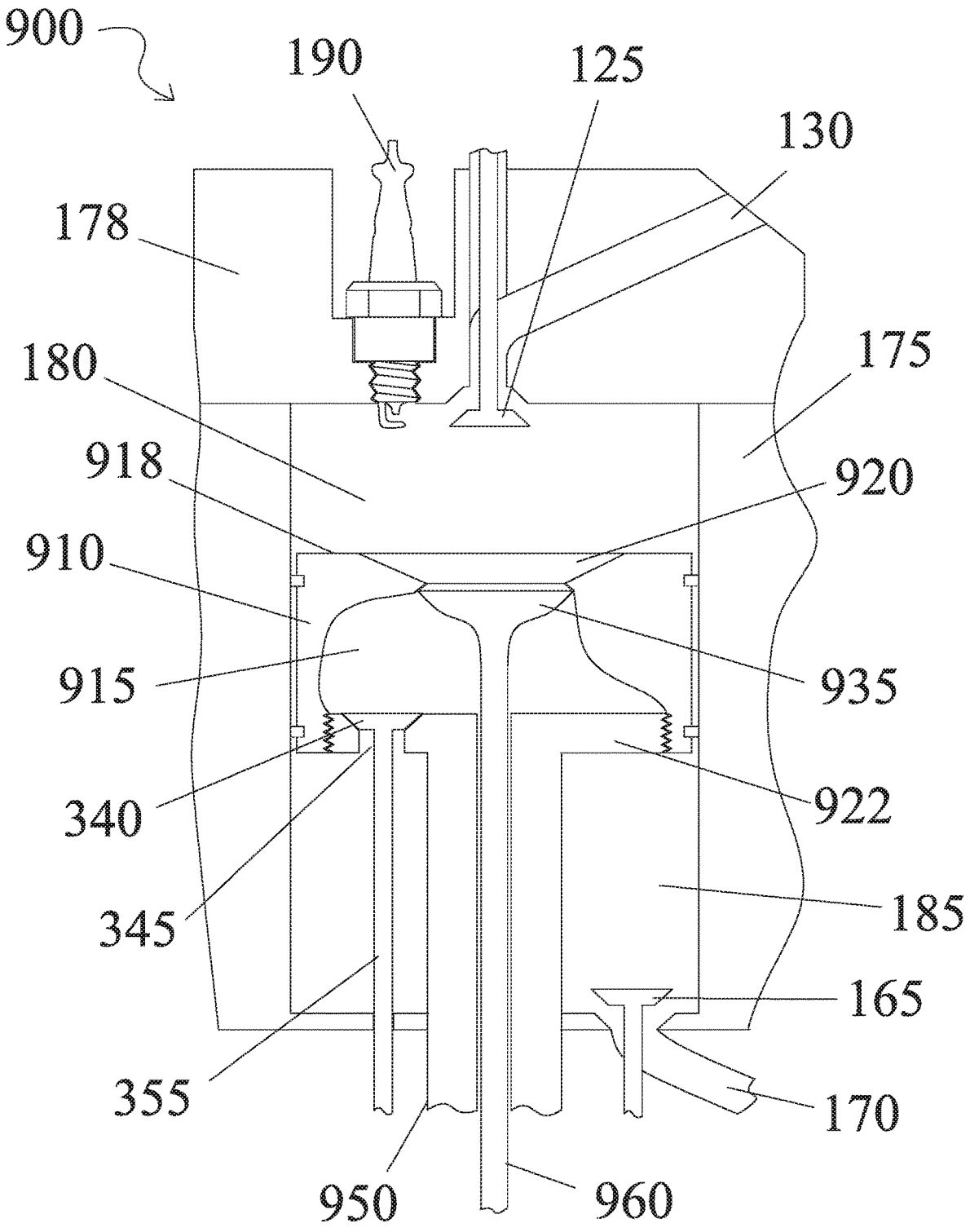
FIG. 20 is a cut-away view of an enhanced piston for improving the efficiency of an internal combustion engine having an asymmetric piston cavity according to an embodiment of the invention.

Now referring to FIG. 20, an enhanced piston for improving the efficiency of an internal combustion engine 900 is shown with an enhanced piston 910 which has an asymmetric piston cavity 915. The shape of asymmetric piston cavity is selected to enhance efficiency in selected environments. The exact shape is not necessarily critical nor is it necessary for the asymmetric portion to be significantly asymmetric. A piston rod 950 has a threaded portion 922 which is used to allow an upper piston valve 935 and an upper piston valve rod 960 to be placed within asymmetric piston cavity 915 as discussed above. In this embodiment, enhanced piston 910 has an upper piston face 918 that is generally flat with an upper piston recessed portion 920. Upper piston valve 935 is connected to upper piston valve rod 960 which is used to selectively seal and unseal asymmetric piston cavity 915 from combustion chamber 180.

Figure 21:
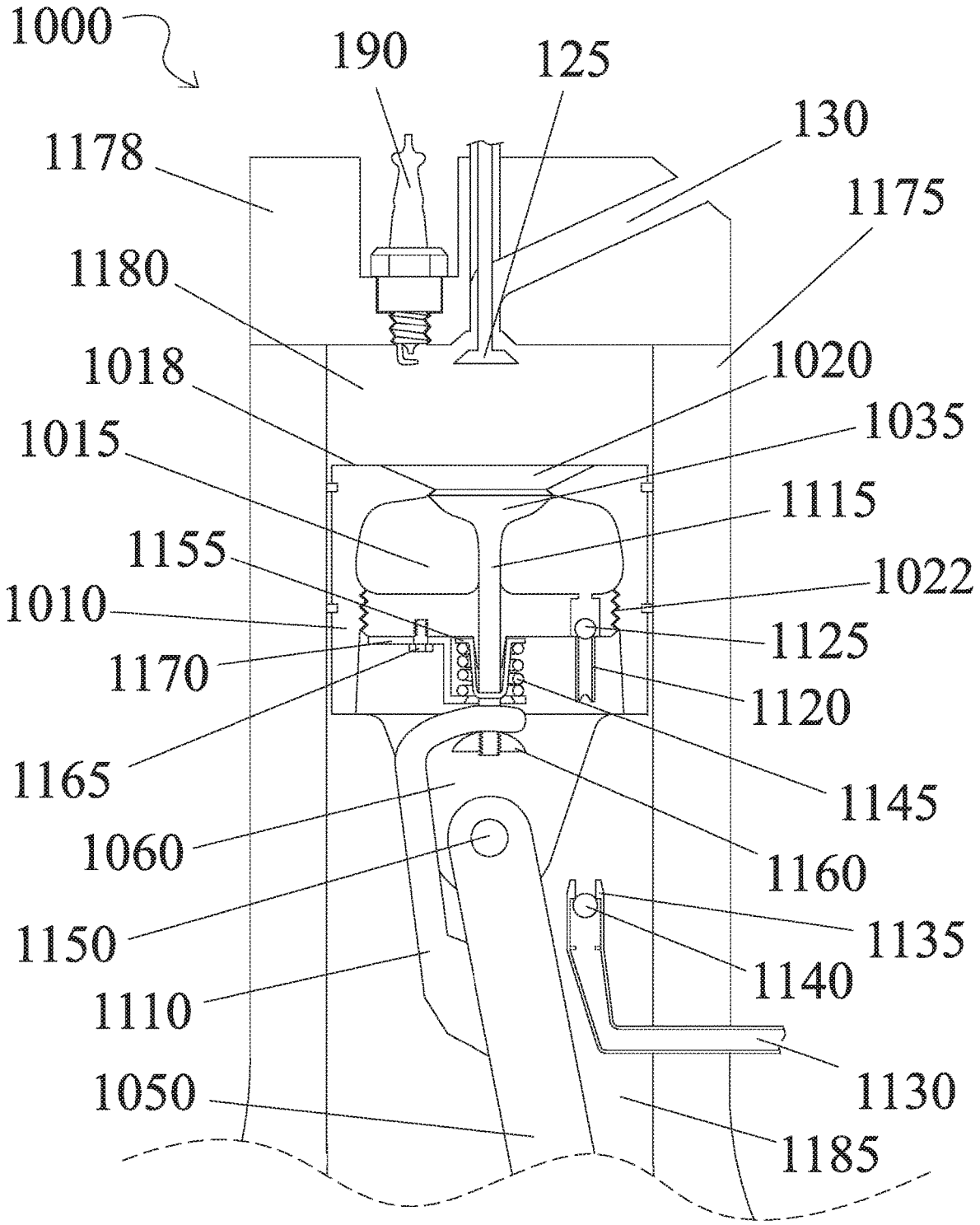
FIG. 21 is a cut-away view of an enhanced piston for improving the efficiency of an internal combustion engine having an alternative piston valve rod actuator assembly according to an embodiment of the invention.

Referring to FIG. 21, an enhanced piston for improving the efficiency of an internal combustion engine 1000 is shown having a cylinder block 1175 that is not sealed at the bottom having an open cylinder portion 1185. An enhanced piston 1010 is moveably disposed within cylinder block 1175 and a cylinder head 1178. Enhanced piston 1919 has a threaded portion 1022 that is used to facilitate assembly as discussed above. Enhanced piston 1010 has a piston cavity 1015 which houses a piston valve 1035 that selectively seals it from a combustion chamber 1180 during operation. An upper piston recessed portion 1020 is disposed on an upper piston face 1018. Piston valve 1035 is connected to a piston valve rod 1115. Piston valve rod 1115 is threaded on a bottom portion and a moon follower 1160 is threaded to removably attach to piston valve rod 1115 and retains a piston valve actuator arm 1110. Moon follower 1160 is a retainer that allows piston valve rod 1115 to be acted upon as connecting rod 1050 moves. Piston valve actuator arm 1110 works in conjunction with connecting rod 1050 to open and close piston valve 1035 to selectively introduce a compressed charge to combustion chamber 1180.

A spring bracket 1170 is provided and attached to threaded portion 1022 with a bolt 1165 and retains a piston valve rod spring 1145 which fits over a bell shaped spring retainer 1155. A piston cavity inlet port 1120 is mounted on a lower surface of threaded portion 1022 and includes a piston cavity inlet valve 1125 that selectively seals off piston cavity 1015 when pressurized. Piston cavity inlet port 1120 fits within a piston cavity inlet connecting port 1135. Piston cavity inlet connecting port 1135 is connected to a high pressure port 1130 and has a piston cavity inlet connecting port valve 1140. Piston cavity inlet connecting port 1135 is disposed in open cylinder portion 1185. In use, as enhanced piston moves towards piston cavity inlet connecting port 1135, piston cavity inlet port 1120 fits in and pushes piston cavity inlet connecting port valve 1140 to an open position which allows high pressure air/fuel mixture to enter piston cavity 1015 through piston cavity inlet port 1120. As enhanced piston 1010 moves away during the next part of the cycle, piston cavity inlet connecting port 1135 detaches and piston cavity inlet valve 1125 seals and retains pressurized air/fuel mixture within piston cavity 1015 until piston valve 1035 opens allowing the pressurized mixture to enter combustion chamber 1180. A piston connecting flange 1060 which is a lower part of enhanced piston 1010 and is connected to connecting rod 1050 with a wrist pin 1150. Of course although bolt 1165 and spring bracket 1170 are shown, other attachment means of securing piston valve rod spring 1145 are possible, such as, but not limited to welding or castings.

Figure 22:
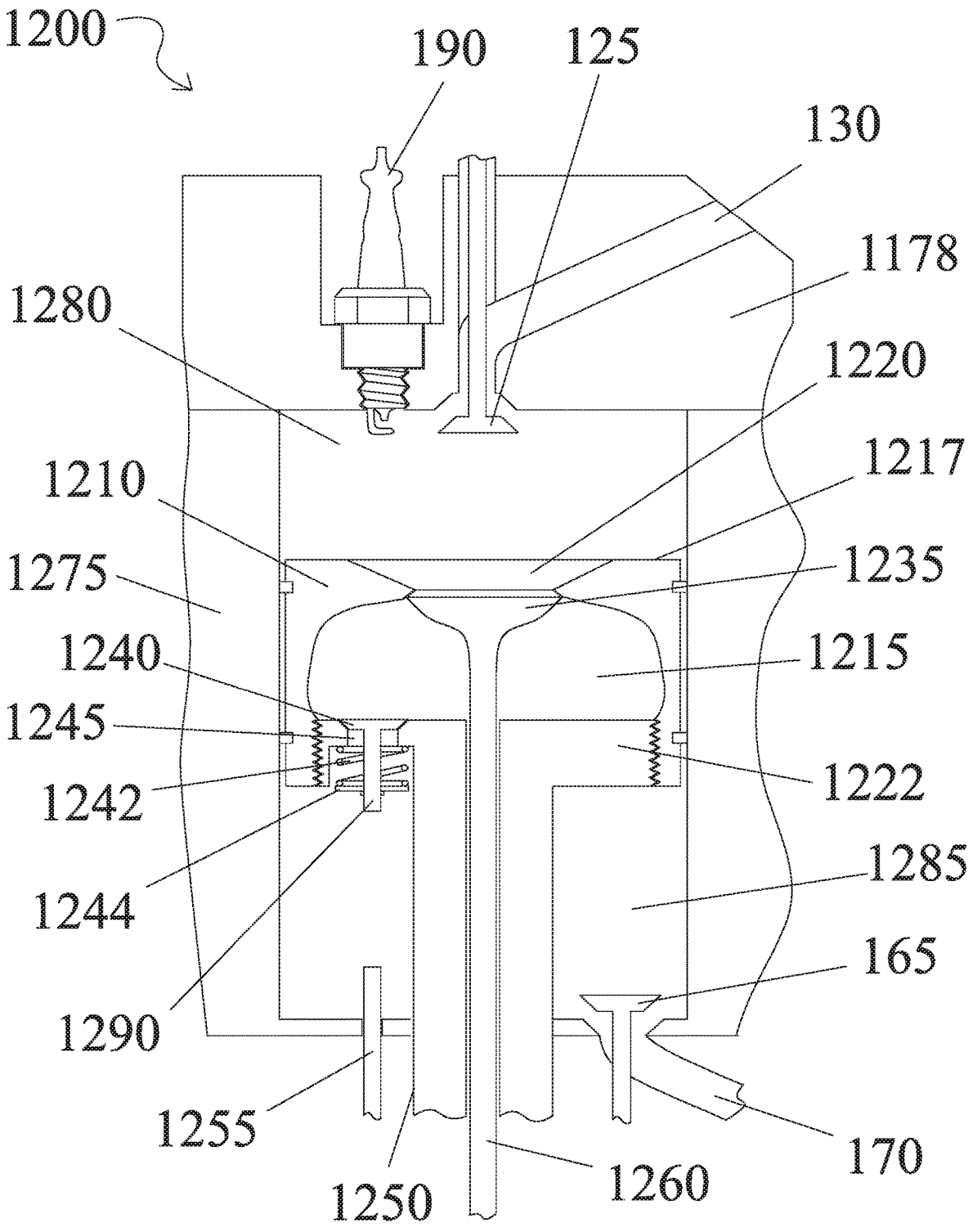
FIG. 22 is a cut-away view of an enhanced piston for improving the efficiency of an internal combustion engine having an alternative lower piston valve configuration according to an embodiment of the invention.

Now referring to FIG. 22, an enhanced piston for improving the efficiency of an internal combustion engine 1200 is shown having an enhanced piston 1210. Enhanced piston 1210 has a piston cavity 1215 and an upper piston face 1217 with an upper piston recessed portion 1220. Enhanced piston 1210 is moveably disposed within a cylinder block 1275 and cylinder head 1178. A combustion chamber 1280 is located above enhanced piston 1210 and a lower cylinder portion 1285 below.

Piston cavity 1215 has a lower piston valve 1240 installed in a piston cavity port 1245 to allow gases to enter from lower cylinder portion 1285 but not flow back through piston cavity port 1245. Lower piston valve 1240 has an attached lower piston valve rod 1290 which has an exposed end. A lower piston valve spring 1242 pushes against a lower piston valve spring retainer 1244 which acts on lower piston valve rod 1290 thus keeping lower piston valve 1240 closed unless acted on by a lower piston valve push rod 1255 whose activation is selected to provide the best engine performance. An upper piston valve 1235 is connected to an upper piston valve rod 1260 and is enclosed in a piston rod 1250. Piston rod 1250 has a threaded portion 1222 similar to the threaded portions discussed above.

It should be clear that the embodiments shown may be used with the differing air/fuel valves and injectors. For example, the enhanced piston shown in FIG. 15 could be used with the valve configuration shown in FIG. 1. It should also be clear, although not generally shown or discussed, seals and rings may be used to seal cylinders and valves as is known in the art. Also, it is known to operate valves using mechanical means such as eccentrics and cams as well as other control methods, such as but not limited to, hydraulic, pneumatic and electronic means.

The instant invention can utilize a double acting piston which results in gases acting on both side of the piston. These combined forces will negate the resultant force that is transferred to the crankshaft and other moving parts. Which means that the frictional losses in the journal bearing of the engine are reduced when compared to traditional engines. An additional benefit of the instant invention is that it allows engine designers to add more devices that can help an engine to run more efficiently such as, but not limited to, multiple sparks plugs, additional valves, feedback sensors, water injectors and fuel injectors.

In prior art engines, neither exhaust or intake valves can be placed ideally since both are competing for the same space. The instant invention does not make this compromise since only the exhaust valve is located in this space.

In prior art the induction process takes place in the same area as the combustion and exhaust cycle; but due to the instant invention's use of a piston cavity the induction process can be done on the other end of the cylinder from those processes where it should be cooler. The benefit of this is that the incoming air should not lose its density by picking up heat from the surroundings thus increasing the engine's volumetric efficiency.

In some embodiments of the instant invention the piston rod takes up space on the lower side of the piston. This means that the lower side of the piston does not displace as much volume as the upper side of the piston. On the top side of the piston where the expansion occurs, there is more piston face area for the hot gases to act on, thus transferring a higher percent of the internal energy of the gas to the crank shaft in the form of work. This is a form of over-expansion which is done in some engines. In some prior art methods, this is accomplished by changing the valve timing to reduce the amount of air entering the engine; however, in that case some of the gain in efficiency due to over-expansion is lost by more pumping losses due to the altered induction cycle.

The instant invention utilizes a power stroke on each revolution of the crank shaft, thus the size of the crank shaft and cylinder head may be reduced. Additionally, since there is an exhaust cycle with every revolution of the crankshaft, the use of a turbocharger is enhanced.

Although the instant invention has been described in relation to particular embodiments thereof, many other variations and modifications and other uses will become apparent to those skilled in the art.

What is claimed is:

1. An enhanced piston for improving the efficiency of an internal combustion engine comprising:

a cylinder;

said cylinder having a combustion chamber and a lower cylinder portion;

a cylinder head disposed on said cylinder;

an enhanced piston moveably disposed within said cylinder;

a piston rod connected to said enhanced piston;

said enhanced piston having a piston cavity;

an upper piston valve connected to an upper piston valve rod;

said upper piston valve disposed within said piston cavity; wherein said upper piston valve selectively seals said piston cavity from said combustion chamber;

a piston cavity port disposed on a bottom portion of said piston cavity;

a lower piston valve; and said lower piston valve disposed within said piston cavity port; wherein said lower piston valve seals said piston cavity port from said lower cylinder portion; wherein gases selectively sealed in said piston cavity are contained under pressure until released in said combustion chamber.

2. The enhanced piston for improving the efficiency of an internal combustion engine according to claim 1 wherein said lower piston valve is a one-way valve wherein gases are only allowed into said piston cavity.

3. The enhanced piston for improving the efficiency of an internal combustion engine according to claim 1 further comprising a lower piston valve rod connected to said lower piston valve.

4. The enhanced piston for improving the efficiency of an internal combustion engine according to claim 1 wherein:

said piston rod having a threaded portion; and said enhanced piston having a matching threaded portion; wherein said threaded portion removably fits within said matching threaded portion.

5. The enhanced piston for improving the efficiency of an internal combustion engine according to claim 1 wherein said piston rod is hollow.

6. The enhanced piston for improving the efficiency of an internal combustion engine according to claim 5 wherein said upper piston valve rod is disposed within said piston rod.

7. The enhanced piston for improving the efficiency of an internal combustion engine according to claim 1 further comprising a lower cylinder portion intake valve disposed in said lower cylinder portion.

8. The enhanced piston for improving the efficiency of an internal combustion engine according to claim 1 wherein said piston cavity is generally ellipsoidal.

9. The enhanced piston for improving the efficiency of an internal combustion engine according to claim 1 wherein said piston cavity has a generally toroidal portion.

10. The enhanced piston for improving the efficiency of an internal combustion engine according to claim 1 wherein said enhanced piston has a generally flat upper piston face.

11. The enhanced piston for improving the efficiency of an internal combustion engine according to claim 1 wherein said enhanced piston has an upper piston recessed portion.

12. The enhanced piston for improving the efficiency of an internal combustion engine according to claim 3 wherein said lower piston valve rod is disposed within said lower cylinder portion but outside said piston rod.

13. The enhanced piston for improving the efficiency of an internal combustion engine according to claim 6 wherein said upper piston valve fits within said lower piston valve wherein said lower piston valve is at least partially protected by said upper piston valve.

14. The enhanced piston for improving the efficiency of an internal combustion engine according to claim 1 further comprising an exhaust valve in communication with said combustion chamber.

15. The enhanced piston for improving the efficiency of an internal combustion engine according to claim 14 further comprising an upper intake valve in communication with said combustion chamber.

16. The enhanced piston for improving the efficiency of an internal combustion engine according to claim 14 further comprising an upper fuel injector disposed in said combustion chamber.

17. An enhanced piston for improving the efficiency of an internal combustion engine comprising:

a cylinder;

said cylinder having a combustion chamber and a lower cylinder portion;

a cylinder head disposed on said cylinder;

an enhanced piston moveably disposed within said cylinder;

a piston rod connected to said enhanced piston;

said enhanced piston having a piston cavity;

an upper piston valve connected to an upper piston valve rod;

said upper piston valve disposed within said piston cavity; wherein said upper piston valve selectively seals said piston cavity from said combustion chamber;

a piston cavity port disposed on a bottom portion of said piston cavity;

a lower piston valve; and said lower piston valve disposed within said piston cavity port; wherein said lower piston valve seals said piston cavity port from said lower cylinder portion; wherein gases selectively sealed in said piston cavity are contained under pressure until released in said combustion chamber;

said lower piston valve having a lower piston valve rod connected to said lower piston valve wherein said lower portion protrudes into a portion of said lower cylinder portion; and a lower piston valve push rod disposed to protrude into said portion of said lower cylinder portion to intermittently make contact with said lower piston valve rod to selectively open and close said lower piston valve.

18. The enhanced piston for improving the efficiency of an internal combustion engine according to claim 17 wherein said piston rod having a threaded portion; said enhanced piston having a matching threaded portion; and wherein said threaded portion removably fits within said matching threaded portion.

19. An enhanced piston for improving the efficiency of an internal combustion engine comprising:

a cylinder;

said cylinder having a combustion chamber and an open cylinder portion;

a cylinder head disposed on said cylinder;

an enhanced piston moveably disposed within said cylinder;

a piston connecting flange on a bottom portion of said enhanced piston, a connecting rod moveably connected to said connecting flange;

said enhanced piston having a piston cavity;

a piston valve moveably disposed within said piston cavity;

a piston valve rod connected to said piston valve wherein said piston valve selectively seals said piston cavity from said combustion chamber;

a piston valve actuator arm connected to said connecting rod;

said piston valve actuator arm slidably disposed to a lower portion of said piston valve rod and secured to said lower portion with a retainer;

a spring bracket disposed on said bottom portion;

a piston valve rod spring retained within said spring bracket wherein said piston valve is biased in a sealed position;

a piston cavity inlet port disposed within said bottom portion;

a piston cavity inlet connecting port disposed within said open cylinder portion; and said piston cavity inlet port adapted to removably fit with said piston cavity inlet connecting port wherein compressed gas is selectively transferred to said piston cavity when said piston cavity inlet connecting port is in contact with said piston cavity inlet port.

20. The enhanced piston for improving the efficiency of an internal combustion engine according to claim 19 wherein said bottom portion having a threaded portion; and wherein said enhanced piston having a matching threaded portion; wherein said threaded portion removably fits within said matching threaded portion.

* * * * *